US010558174B2

(12) United States Patent
Kinoshita

(10) Patent No.: US 10,558,174 B2
(45) Date of Patent: Feb. 11, 2020

(54) ELECTRONIC TIMEPIECE

(71) Applicant: Seiko Epson Corporation, Tokyo (JP)

(72) Inventor: Eiji Kinoshita, Matsumoto (JP)

(73) Assignee: Seiko Epson Corporation (JP)

( * ) Notice: Subject to any disclaimer, the term of this patent is extended or adjusted under 35 U.S.C. 154(b) by 95 days.

(21) Appl. No.: 15/872,469

(22) Filed: Jan. 16, 2018

(65) Prior Publication Data

US 2018/0203419 A1 Jul. 19, 2018

(30) Foreign Application Priority Data

Jan. 17, 2017 (JP) ..... 2017-006218

(51) Int. Cl.
*G04R 20/04* (2013.01)

(52) U.S. Cl.
CPC ..... *G04R 20/04* (2013.01)

(58) Field of Classification Search
CPC ..... G04R 20/04; G04G 21/02
USPC ..... 368/47, 46, 10, 14
See application file for complete search history.

(56) References Cited

U.S. PATENT DOCUMENTS 8,432,771 B2 * 4/2013 Matsuzaki ..... G04R 20/04 368/47
8,644,117 B2 * 2/2014 Matsuzaki ..... G04R 20/04 368/47
2007/0241959 A1 10/2007 Nakagawa
2010/0091614 A1 * 4/2010 Fujisawa ..... G01S 19/24 368/14
2016/0026157 A1 1/2016 Baba
2018/0074461 A1 * 3/2018 Matsue ..... G04R 20/02

FOREIGN PATENT DOCUMENTS

JP 2007-271538 A 10/2007
JP 2016-031232 A 3/2016

* cited by examiner

*Primary Examiner* — Edwin A. Leon
(74) *Attorney, Agent, or Firm* — Harness, Dickey & Pierce, P.L.C.

(57) ABSTRACT

Provided is an electronic timepiece capable of receiving satellite signals from multiple types of positioning information satellites, and capable of shortening the time required to correct the internal time. The electronic timepiece has a receiver; an estimator that estimates internal time error; a mode setter configured to set a time correction mode according to the estimated error; a selector that selects the type of positioning information satellite according to the time correction mode that was set; a time adjustor.

10 Claims, 18 Drawing Sheets

| Frame | String | 100 bits = 2 seconds | | | |
|---|---|---|---|---|---|
| | | 1.7 seconds | | | 0.3 seconds |
| 1~5 | 1 | 0 | Immediate data | KX | MB |
| | 2 | 0 | Immediate data | KX | MB |
| | 3 | 0 | Immediate data | KX | MB |
| | 4 | 0 | Immediate data | KX | MB |
| | 5 | 0 | Non-Immediate data | KX | MB |
| | ⋮ | | ⋮ | ⋮ | ⋮ |
| | 13 | 0 | Non-Immediate data | KX | MB |
| | 14 | 0 | Non-Immediate data | KX | MB |
| | 15 | 0 | Non-Immediate data | KX | MB |

30 seconds

FIG. 9

| ELAPSED TIME (HOURS) | MAXIMUM INTERNAL TIME ERROR (±ms) |
|---|---|
| 1 | 20 |
| 2 | 40 |
| 3 | 60 |
| ▪ | ▪ |
| ▪ | ▪ |
| 12 | 250 |
| ▪ | ▪ |
| ▪ | ▪ |
| 24 | 500 |

FIG. 15

ELECTRONIC TIMEPIECE

BACKGROUND

1. Technical Field

The present invention relates to an electronic timepiece capable of receiving satellite signals.

2. Related Art

Electronic timepieces that receive satellite signals transmitted from positioning information satellites such as GPS (Global Positioning System) satellites, acquire time information and positioning information from the satellite signals, and correct the kept time based on the received information, are known from the literature. Such electronic timepieces include timepieces that receive satellite signals from multiple different types of positioning information satellites.

The electronic timepiece described in JP-A-2016-31232 has a GPS receiver for receiving satellite signals transmitted from GPS satellites, and a GLONASS receiver for receiving satellite signals transmitted from GLONASS (Global Navigation Satellite System) satellites. When executing the reception process, the electronic timepiece exclusively operates the GPS receiver and the GLONASS receiver, sequentially searches for GPS satellites and GLONASS satellites, receives satellite signals from the satellites that are locked, and acquires time information. Based on the acquired time information, the electronic timepiece then adjusts the internal time.

Because the electronic timepiece described in JP-A-2016-31232 corrects the internal time by receiving satellite signals and acquiring time information, some time is required to correct the internal time after starting the reception process. Shortening the time required to correct the internal time is therefore desirable.

SUMMARY

An object of the present invention is to provide an electronic timepiece capable of receiving satellite signals from multiple types of positioning information satellites, and capable of shortening the time required to correct the internal time.

An electronic timepiece according to the invention has: a receiver configured to receive satellite signals transmitted from multiple types of positioning information satellites; an estimator configured to estimate internal time error; a mode setter configured to set a first time correction mode or second time correction mode according to the estimated error; a selector configured to select the type of positioning information satellite from which to receive satellite signals according to the set time correction mode; a reception controller configured to control the receiver to execute a process appropriate to the set time correction mode; and a time adjustor configured to correct the internal time. When the first time correction mode is set, the receiver receives the satellite signals transmitted from the type of positioning information satellite selected by the selector, acquires at least time synchronization information, and outputs a synchronization signal indicating the seconds update timing based on the time synchronization information; and the time adjustor corrects the internal time based on the synchronization signal. When the second time correction mode is set, the receiver receives the satellite signals transmitted from the type of positioning information satellite selected by the selector, acquires time synchronization information and satellite time information, and outputs the synchronization signal and time information; and the time adjustor corrects the internal time based on the synchronization signal and the time information.

Because the electronic timepiece can adjust the update timing of the second of the internal time by acquiring time synchronization information, if the difference of the internal time to the time transmitted by the positioning information satellite is ±0.5 seconds, for example, the internal time may be correctly adjusted without receiving the satellite time information if the time synchronization information is acquired. However, if the internal time error is greater than or equal to ±0.5 seconds, the time synchronization information and satellite time information must be acquired to correct the internal time.

In this aspect of the invention, the estimator estimates the internal time, and the mode setter sets either a first time correction mode or second time correction mode according to the estimated error.

As a result, if the internal time error is less than ±0.5 seconds, and it is determined that the internal time can be correctly adjusted by acquiring the time synchronization information, the first time correction mode, which acquires time synchronization information, can be set. If the internal time error is greater than or equal to than ±0.5 seconds, and it is determined that time synchronization information and satellite time information must be acquired to adjust the internal time, the second time correction mode, which acquires time synchronization information and satellite time information, can be set.

The average time required to acquire time synchronization information, and the average time required to acquire satellite time information, may differ according to the type of positioning information satellite.

As a result, the selector in the invention selects the type of positioning information satellites from which to receive satellite signals according to the time correction mode that is set. For example, if the first time correction mode is set, positioning information satellites of the type with the shortest average time required to acquire the time synchronization information are selected. If the second time correction mode is set, positioning information satellites with the shortest average time required to receive both time synchronization information and satellite time information are selected.

If the first time correction mode is set, the receiver receives satellite signals from positioning information satellites of the type selected by the selector, time synchronization information is acquired, and a synchronization signal is output. The time adjustor then corrects the internal time based on the synchronization signal.

If the second time correction mode is set, the receiver receives satellite signals from positioning information satellites of the type selected by the selector, time synchronization information and satellite time information are acquired, and a synchronization signal and time information are output. The time adjustor then corrects the internal time based on the synchronization signal and time information.

As a result, the invention can shorten the time required to correct the internal time after the reception process starts both when the internal time is corrected by acquiring only time synchronization information, and when the internal time is corrected by acquiring time synchronization information and satellite time information.

For example, GPS satellites transmit both time synchronization information and satellite time information at a 6-second interval. As a result, when receiving satellite signals from GPS satellites, time synchronization information and satellite time information can be acquired within 6 seconds if the reception environment is good. GLONASS satellites, however, transmit time synchronization information at a 2-second interval and satellite time information at a 30-second interval. As a result, when receiving satellite signals from GLONASS satellites, time synchronization information can be acquired within 2 seconds if the reception environment is good, but it may take up to 30 seconds to acquire the satellite time information even if the reception environment is good.

For example, if the receiver of the invention is configured to receive satellite signals from both GPS satellites and GLONASS satellites, and the internal time is corrected by acquiring time synchronization information, satellite signals are received from GLONASS satellites to acquire the time synchronization information. As a result, the time required until the internal time is corrected can be shortened compared with acquiring time synchronization information from GPS satellites.

If the internal time is corrected by acquiring time synchronization information and satellite time information, satellite signals are received from GPS satellites to acquire the time synchronization information and satellite time information. As a result, the time required until the internal time is corrected can be shortened compared with acquiring time synchronization information and satellite time information from GLONASS satellites.

In an electronic timepiece according to another aspect of the invention, the estimator counts the elapsed time from when the internal time was corrected, and estimates the internal time error based on the elapsed time and the accuracy of the timepiece.

Error in the internal time increases proportionally to the elapsed time after the internal time is corrected. As a result, the current error in the internal time can be accurately estimated based on the time past since the time was last corrected, and the accuracy (such as the monthly accuracy) of the timepiece, which is determined by the clock precision of the crystal oscillator, for example.

In an electronic timepiece according to another aspect of the invention, the selector, when the first time correction mode is set, selects the type of positioning information satellite that transmits the time synchronization information at the shortest interval; and when the second time correction mode is set, selects the type of positioning information satellite for which the longer of the time synchronization information transmission interval and satellite time information transmission interval is shortest.

The transmission interval of the time synchronization information and satellite time information is predetermined by the type of positioning information satellite.

The average time required to acquire time synchronization information after the reception process starts is proportional to the transmission interval of the time synchronization information. The average time required to acquire satellite time information after the reception process starts is proportional to the transmission interval of the satellite time information.

As a result, when the first time correction mode is set, the average time required by the reception process can be shortened by selecting positioning information satellites of the type that transmit the time synchronization information at the shortest transmission interval. When the second time correction mode is set, the average time of the reception process can be shortened by selecting the type of positioning information satellite for which the longer of the time synchronization information transmission interval and satellite time information transmission interval is shortest.

In an electronic timepiece according to another aspect of the invention, the receiver can receive satellite signals transmitted from GLONASS satellites; and the selector selects GLONASS satellites when the first time correction mode is set.

As described above, GPS satellites transmit time synchronization information and satellite time information at a 6-second interval, and GLONASS satellites transmit time synchronization information at a 2-second interval and satellite time information at a 30-second interval.

When the first time correction mode is set to acquire time synchronization information, this aspect of the invention receives satellite signals transmitted from GLONASS satellites. The time required to acquire time synchronization information can therefore be shortened compared with when satellite signals transmitted from GPS satellites are received, for example.

In an electronic timepiece according to another aspect of the invention, the receiver can receive satellite signals transmitted from GPS satellites; and the selector selects GPS satellites when the second time correction mode is set.

When the second time correction mode is set and time synchronization information and satellite time information are acquired, this aspect of the invention receives satellite signals transmitted from GPS satellites. The time required to acquire both time synchronization information and satellite time information can therefore be shortened compared with receiving satellite signals transmitted from GLONASS satellites, for example.

An electronic timepiece according to another aspect of the invention preferably also has a difference counter configured to measure the difference between the update timing of the second of the internal time, and the synchronization signal when the first time correction mode is set; and the mode setter sets the second time correction mode when the first time correction mode is set and the difference measured by the difference counter is greater than the error estimated by the estimator.

Furthermore, if the first time correction mode is set but the actual error in the internal time is greater than the estimated difference, and whether or not the internal time can be adjusted correctly based only on the synchronization signal is not known, a second time correction mode is set. In this event, the internal time is corrected based on the synchronization signal and satellite time information, and the internal time can therefore be adjusted correctly.

In an electronic timepiece according to another aspect of the invention, the receiver is configured to execute a timekeeping reception process and a positioning reception process; the mode setter sets the first time correction mode or second time correction mode according to the estimated error when the receiver executes the timekeeping reception process, and sets the third time correction mode when the receiver executes the positioning reception process; and when the third time correction mode is set, the receiver calculates and acquires positioning information based on the satellite signals transmitted from the type of positioning information satellites selected by the selector, and the time adjustor adjusts the displayed time based on the acquired positioning information.

The positioning information reception process must lock onto more positioning information satellites than the timekeeping reception process, and power consumption required for the positioning information reception process is therefore greater.

When executing the positioning information reception process, this aspect of the invention can receive satellite signals from positioning information satellites of the type requiring the least power for the reception process, and can therefore reduce power consumption.

Other objects and attainments together with a fuller understanding of the invention will become apparent and appreciated by referring to the following description and claims taken in conjunction with the accompanying drawings.

BRIEF DESCRIPTION OF THE DRAWINGS

FIG. 9 describes the format of the navigation message of a GLONASS satellite signal.

FIG. 15 illustrates the relationship between the elapsed time and the internal time difference.

DESCRIPTION OF EMBODIMENTS

A preferred embodiment of the present invention is described below with reference to the accompanying figures.

Figure 1:
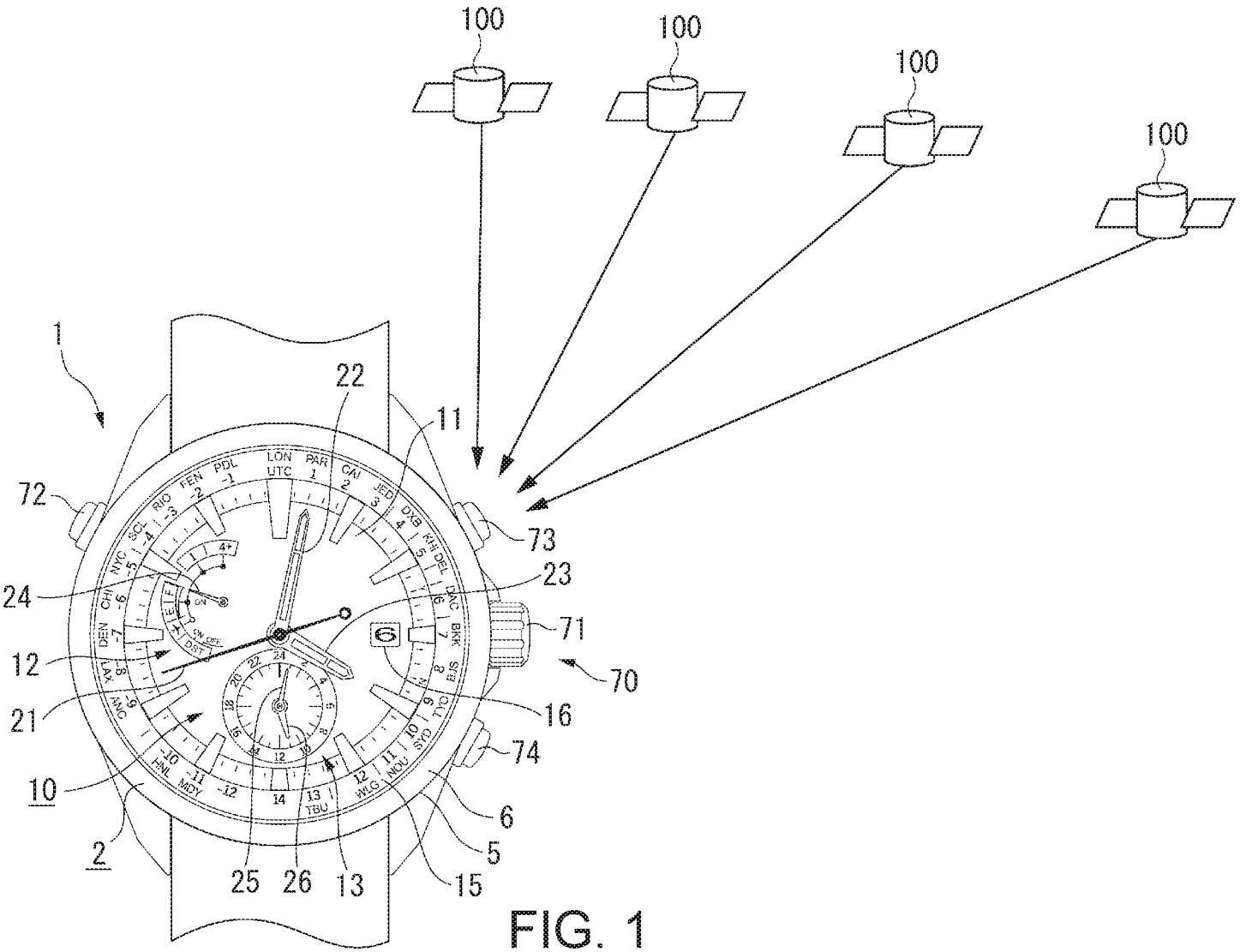
FIG. 1 is a front view of an electronic timepiece according to the invention.

FIG. 1 is a front view of an electronic timepiece 1 according to a first embodiment of the invention.

As shown in FIG. 1, the electronic timepiece 1 in this embodiment of the invention receives satellite signals from at least one positioning information satellite 100 to generate time information, and receives satellite signals from at least three positioning information satellites 100 to generate positioning information. The positioning information satellites 100 may be in the GPS satellite or GLONASS satellite constellations each comprising multiple satellites orbiting the Earth on specific orbits.

Electronic Timepiece

The electronic timepiece 1 is a wristwatch worn on the user's wrist, and has a display device 10 for displaying the time and an input device 70.

Electronic Timepiece Construction

The electronic timepiece 1 has an external case 2, crystal, and back cover. The external case 2 includes a bezel 6 made of ceramic or metal fit to a cylindrical case member 5 made of metal.

Of the two openings in the external case 2, the opening on the face side is covered by the crystal held by the bezel 6, and the opening on the back is covered by the back cover, which is metal.

Inside the external case 2 are a dial ring 15 attached to the inside circumference of the bezel 6; an optically transparent dial 11; hands 21, 22, 23 attached to a center pivot; an indicator hand 24; subdial hands 25, 26; and a drive mechanism 20 that drives the hands 21, 22, 23, indicator hand 24, and subdial hands 25, 26. See FIG. 2.

An input device 70 including a crown 71 and three buttons 72, 73, 74 is disposed to the side of the external case 2.

Display Device

The display device 10 includes the dial 11, hands 21, 22, 23, indicator hand 24, subdial hands 25, 26, and a date wheel.

A large part of the dial 11 is made from a non-metallic material (such as plastic or glass) that easily passes light and microwaves in the 1.5 GHz band.

The dial 11 includes a scale 12 with markers pointed to by the indicator hand 24, a subdial 13 corresponding to the subdial hands 25, 26, and a date window 16 through which a date number on the date wheel can be seen.

Basic Timepiece

The hands 21, 22, 23 are disposed on the face side of the dial 11. Hand 21 is the second hand, hand 22 is the minute hand, and hand 23 is the hour hand. A scale (markers) for indicating the time with the hands 21, 22, 23 is disposed to the dial ring 15.

The hands 21, 22, 23, dial 11, and dial ring 15 thus embody a basic analog timepiece for displaying the time. The basic timepiece primarily indicates the time at the current location. For example, when the electronic timepiece 1 is used in Honolulu, it displays the current local time in Honolulu.

Indicator Dial

The indicator hand 24 is disposed near 10:00 on the face of the dial 11, and indicates various information by pointing to particular positions (markers) on the scale 12.

The indicator hand 24 points to DST (daylight saving time) on the scale 12 when daylight saving time is in effect. By manipulating the input device 70, such as the crown 71 or a button 72, and setting the indicator hand 24 to ON or OFF in the DST range, the daylight saving time mode of the electronic timepiece 1 can be turned on or off.

The airplane icon shown on the scale 12 indicates an airplane mode. By manipulating the input device 70 to set the indicator hand 24 to the airplane icon and selecting the airplane mode, the satellite signal reception function of the electronic timepiece 1 can be turned off.

The E and F on the scale 12 indicate the power reserve (remaining battery capacity).

The 1 and 4+ on the scale 12 indicate the reception mode. The indicator hand 24 points to 1 when in the timekeeping mode (time reception process) acquiring time information, and the indicator hand 24 points to 4+ when in the positioning mode (position reception process) acquiring positioning information. The user can therefore know whether the electronic timepiece 1 is in the timekeeping mode or the positioning mode by reading the indicator hand 24.

Small Clock

The subdial hands 25, 26 are disposed at 6:00 on the face of the dial 11. Hand 25 is the minute hand, and hand 26 is the hour hand. The subdial 13 has a 24-hour scale for displaying the time with the subdial hands 25, 26.

As a result, the subdial hands 25, 26 and subdial 13 embody a small clock for displaying the time. The small clock generally displays the time in a previously set second time zone such as the time at home when travelling (in this example, the time in Japan).

Dial Ring

The dial ring 15 is disposed around the dial 11. The dial ring 15 is made of plastic, for example, and has a flat portion disposed parallel to the crystal, and a beveled portion sloping from the inside circumference part of the flat portion down toward the dial 11. The dial ring 15 is shaped like a ring when seen in plan view, and is conically shaped when seen in section. The flat part and beveled part of the dial ring 15, and the inside circumference surface of the bezel 6, create donut-shaped space inside of which a ring-shaped antenna 110 is housed. See FIG. 2.

A scale (markers) for indicating the time with the hands 21, 22, 23, numbers for indicating the time difference in the time zone, and letters denoting the name of a city in the time zone, are shown on the dial ring 15.

Input Device

When the input device 70 is manually operated, a process corresponding to the operation is performed.

More specifically, when the crown 71 is pulled out one stop, the second hand 21 points to the currently set time zone. To change the currently set time zone from this position, turning the crown 71 to the right (clockwise) moves the second hand 21 clockwise and advances the time zone setting +1, and turning the crown 71 to the left (counterclockwise) moves the second hand 21 counterclockwise and moves the time zone setting −1. Pushing the crown 71 in sets the selected time zone.

More specifically, the second hand 21 also moves when the crown 71 is at the first stop and turned, enabling the user to manually select the time zone by moving the second hand 21 to the time difference or the city name of the desired time zone shown on the dial ring 15.

When the crown 71 is pulled out to the second stop and turned to move the hands 21, 22, 23, the currently displayed time can be adjusted manually.

Pushing the button 72 executes a process appropriate to the current operation, such as cancelling the operating mode or stopping the reception process.

Pushing the button 73 for a first set time (such as greater than or equal to 3 seconds and less than 6 seconds) and then releasing the button 73 manually starts the reception process in the timekeeping mode (manual reception process). During this reception process, the indicator hand 24 points to the 1 on the scale 12 indicating the timekeeping mode.

Pushing the button 73 for a second set time (such as 6 seconds or more) that is longer than the first set time and then releasing the button 73 manually starts the reception process in the positioning mode (manual reception process). During this reception process, the indicator hand 24 points to the 4+ on the scale 12 indicating the positioning mode.

Pushing the button 73 for a short time (such as less than 3 seconds) that is shorter than the first set time and then releasing the button 73 starts the result display process indicating the result of the previous reception process. More specifically, the most recent reception process is displayed by the indicator hand 24 pointing to 1 or 4+. The reception result is indicated by the second hand 21 pointing to Y (reception success) or N (reception failure). Note that the Y is at the 12 second position, and the N is at the 18 second position in this embodiment of the invention.

The processes executed when the buttons 72, 73, 74 are pressed are not limited to the foregoing, and may be set appropriately according to the functions of the electronic timepiece 1.

Solar Panel

Figure 2:
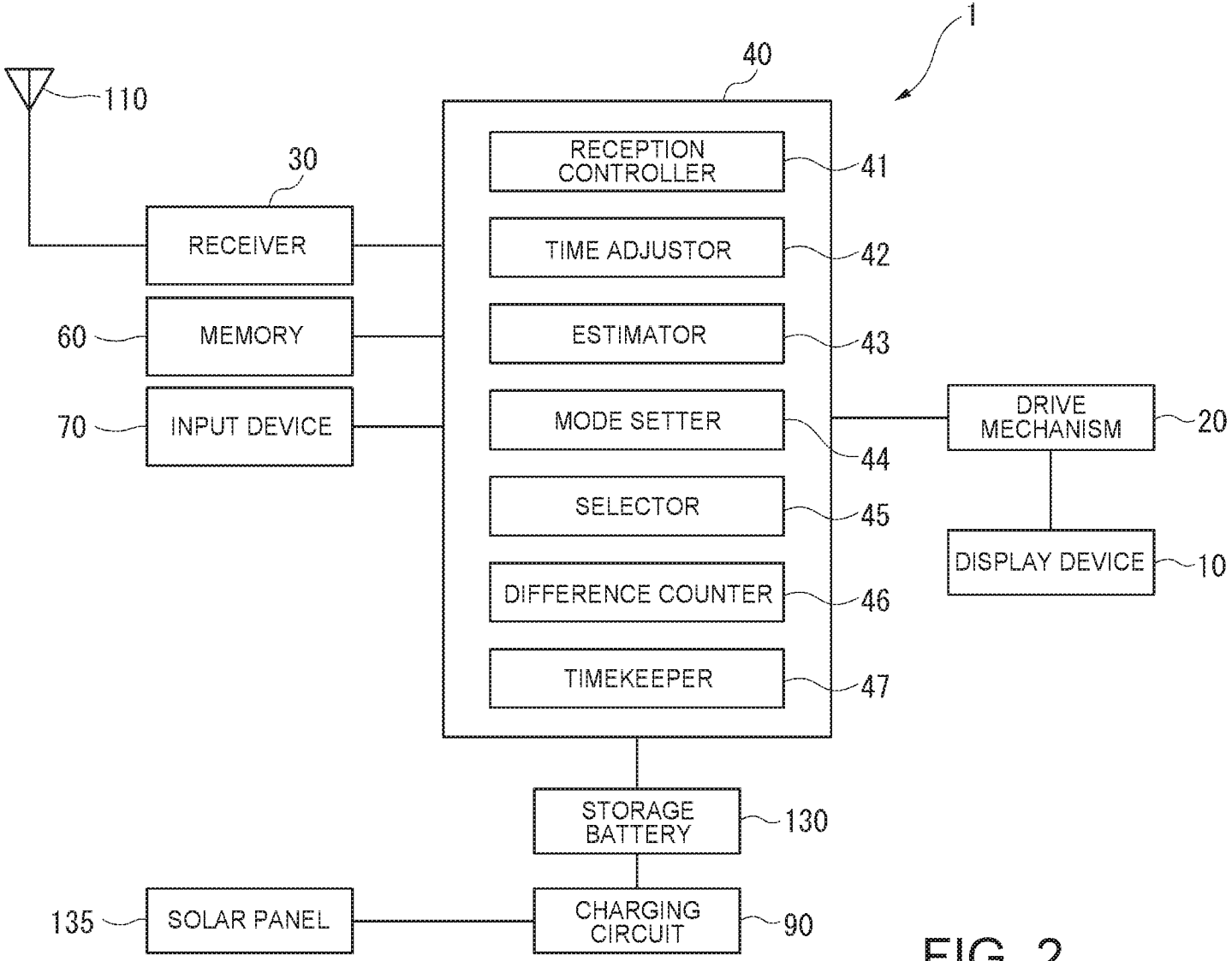
FIG. 2 is a block diagram illustrating the configuration of a electronic timepiece according to the invention.

A solar panel 135, which is a photovoltaic power generator, is disposed between the dial 11 and a main plate to which the drive mechanism 20 is disposed (see FIG. 2). The solar panel 135 is a round flat panel having plural solar cells (photovoltaic devices) connected in series that convert light energy to electrical energy (power). The solar panel 135 also has a sunlight detection function.

Drive Mechanism

The drive mechanism 20 is disposed on the back cover side of the dial 11, and includes a stepper motor that drives the second hand 21, a stepper motor that drives the minute hand 22 and the hour hand 23, a stepper motor that drives indicator hand 24, and a stepper motor that drives subdial hands 25, 26. Because the electronic timepiece 1 has a date wheel for showing the date in the date window 16, the electronic timepiece 1 also has a stepper motor that drives the date wheel.

Circuit Board

A circuit board and lithium ion battery or other type of storage battery 130 (FIG. 2) are on the back cover side of the dial 11. The circuit board has a receiver (receiver module) 30 for receiving satellite signals (FIG. 2), and a control device 40 (FIG. 2). The storage battery 130 is a storage device that is charged through a charging circuit 90 (see FIG. 2) with power produced by the solar panel 135.

Antenna

The antenna 110 is made by forming a metal antenna pattern by plating or a silver paste printing process on a ring-shaped dielectric substrate. The dielectric can be made by mixing titanium oxide or other dielectric material that can be used at high frequencies with resin, which combined with the wavelength shortening effect of the dielectric enables using a small antenna. The antenna is not limited to a ring antenna as used in this embodiment, and may be a patch antenna, for example.

The antenna 110 connects to the circuit board through a suitable connector.

Circuit Configuration of the Electronic Timepiece

FIG. 2 is a block diagram illustrating the circuit configuration of the electronic timepiece 1. The electronic timepiece 1 includes a receiver 30, controller 40, memory 60, and input device 70. The controller 40 includes a reception controller 41, time adjustor 42, estimator 43, mode setter 44, selector 45, difference counter 46, and timekeeper 47.

Receiver

The receiver 30 is a load that is driven by power stored in the storage battery 130, and when driven by the controller 40, receives satellite signals transmitted from positioning information satellites 100 through the antenna 110. When satellite signal reception is successful, the receiver 30 outputs a synchronization signal identifying the seconds update timing, time information, and positioning information for the current location, to the controller 40. If satellite signal reception fails, the receiver 30 sends a failure report to the controller 40.

The receiver 30 is described in detail below with reference to FIG. 3 and FIG. 4.

Figure 3:
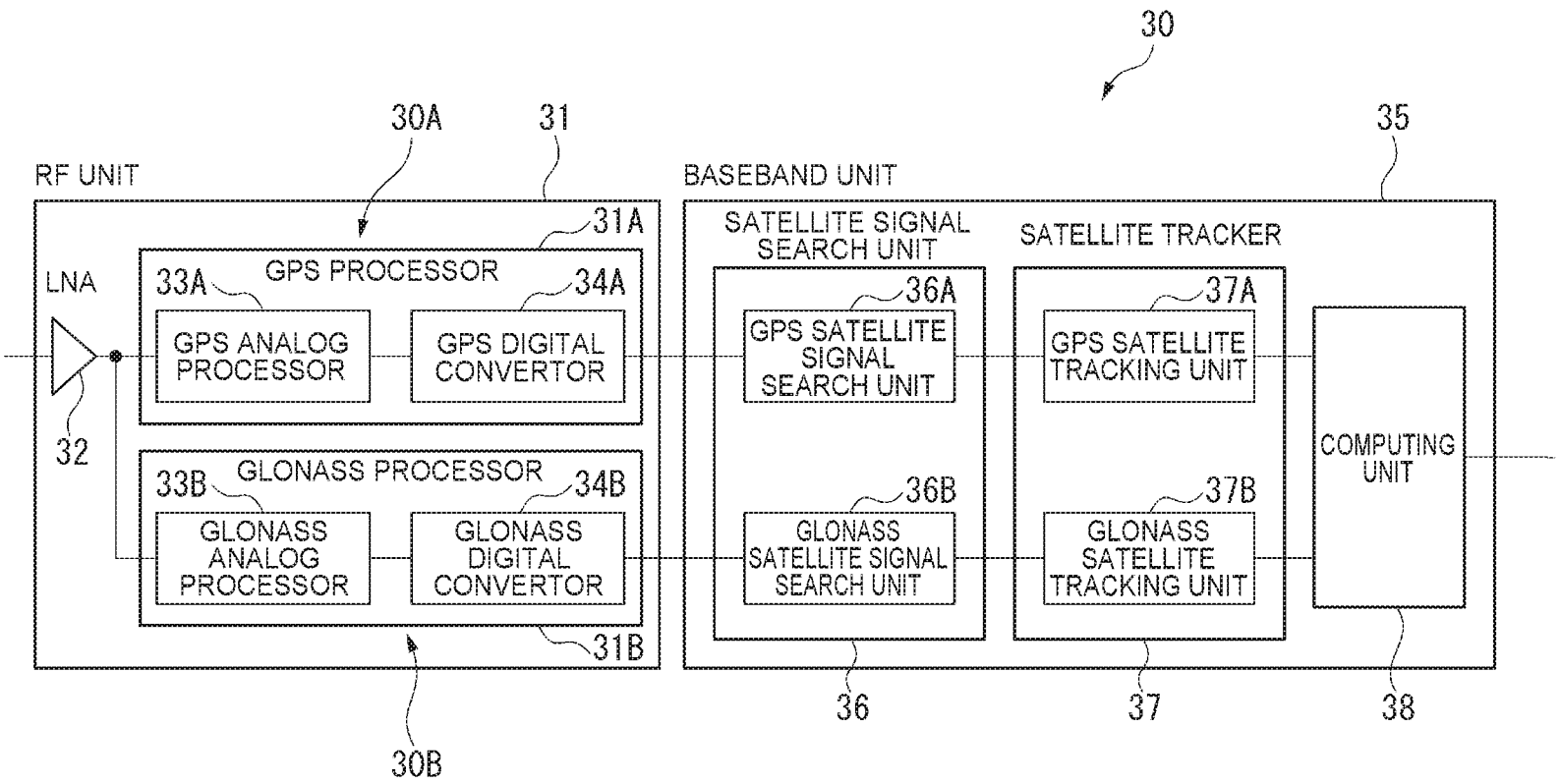
FIG. 3 is a block diagram illustrating the configuration of the receiver in a preferred embodiment of the invention.

As shown in FIG. 3, the receiver 30 includes an RF (radio frequency) unit 31 that receives and converts satellite signals transmitted from positioning information satellites 100 (FIG. 1) to digital signals, and a baseband unit 35 that correlates the received signals and demodulates the navigation message. Note that the receiver 30 in this embodiment of the invention is configured to receive satellite signals transmitted from two types of positioning information satellites, GPS satellites and GLONASS satellites.

RF Unit

The RF unit 31 includes a low noise amplifier (LNA) 32 that amplifies satellite signals received through the antenna 110, and a GPS processor 31A and GLONASS processor 31B to which the satellite signals amplified by the LNA 32 are input.

The GPS processor 31A has a GPS analog processor 33A that processes GPS satellite signals (analog signals) received from GPS satellites, and a GPS digital convertor 34A, which is an analog/digital converter (ADC) for converting the analog signals processed by the GPS analog processor 33A to digital signals.

The GLONASS processor 31B has a GLONASS analog processor 33B that processes GLONASS satellite signals (analog signals) received from GLONASS satellites, and a GLONASS analog processor 33B, which is an analog/digital converter (ADC) for converting the analog signals processed by the GLONASS analog processor 33B to digital signals.

Baseband Unit

The baseband unit 35 includes a satellite signal search unit 36, satellite tracker 37, and computing unit 38.

The satellite signal search unit 36 includes a GPS satellite signal search unit 36A and a GLONASS satellite signal search unit 36B.

The satellite tracker 37 includes a GPS satellite tracker 37A and a GLONASS satellite tracker 37B.

Circuits of the Analog Processor

The circuit design of the GPS analog processor 33A and GLONASS analog processor 33B is described next with reference to FIG. 4. Note that the LNA 32, GPS analog processor 33A, and GLONASS analog processor 33B embody the analog processor 33 of the RF unit 31. The input node IN of the analog processor 33 is connected to the antenna 110 from which satellite signals are input; and a TCXO (temperature-compensated crystal oscillator) is connected to the clock signal input node CLK (not shown in the figure) to which a reference clock signal of a substantially constant frequency regardless of temperature is input.

The GPS analog processor 33A includes a mixer 331A, PLL circuit 332A, IF amplifier 333A, IF filter 334A, and IF amplifier 335A.

The GLONASS analog processor 33B likewise includes a mixer 331B, PLL circuit 332B, IF amplifier 333B, IF filter 334B, and IF amplifier 335B.

Each PLL circuit 332A, 332B has a VCO (voltage controlled oscillator), and generates and outputs a local frequency signal using the reference clock signal input from the clock signal input pin CLK.

The GPS analog processor 33A and GLONASS analog processor 33B function exclusively as described further below. More specifically, while the GPS analog processor 33A is functioning (operating), the GLONASS analog processor 33B is held in a non-functioning state. While the GLONASS analog processor 33B is functioning (operating), the GPS analog processor 33A is held in a non-functioning state. Therefore, that the GPS analog processor 33A and GLONASS analog processor 33B function exclusively means that the GPS analog processor 33A and GLONASS analog processor 33B do not function simultaneously. This includes not only when the GPS analog processor 33A and GLONASS analog processor 33B alternately function continuously, but also when one of the GPS analog processor 33A and GLONASS analog processor 33B functions and then the other functions after waiting a period in which neither functions.

Note that the current supply may be stopped when the GPS analog processor 33A and GLONASS analog processor 33B are not functioning, but to enable them to operate quickly when restored to the functioning state, the IF amplifier 333A, 335A, IF amplifier 333B, 335B are preferably held in an idle state with current supplied thereto. Because the GPS analog processor 33A and GLONASS analog processor 33B in the non-functioning or idle state are substantially stable at a current level that is low compared with when they are operating, current consumption will not increase and require a high capacity battery even when one of the GPS analog processor 33A and GLONASS analog processor 33B is operating and the other is not (is idle).

After being amplified by the LNA 32, the satellite signal received through the antenna 110 is processed by the GPS analog processor 33A or the GLONASS analog processor 33B.

While the GPS analog processor 33A is functioning, the satellite signal amplified by the LNA 32 is mixed by the mixer 331A with the local frequency signal output by the PLL circuit 332A, and down-converted to an intermediate frequency (IF) signal. The IF signal mixed by the mixer 331A passes the IF amplifier 333A, IF filter 334A, and IF amplifier 335A, and is output from the output node OUT1 of the GPS analog processor 33A to the GPS digital convertor 34A.

The GPS digital convertor 34A converts the IF signal output from the GPS analog processor 33A to a digital signal.

While the GLONASS analog processor 33B is functioning, the satellite signal amplified by the LNA 32 is mixed by the mixer 331B with the local frequency signal output by the PLL circuit 332B, and down-converted to an intermediate frequency (IF) signal. The IF signal mixed by the mixer 331B passes the IF amplifier 333B, IF filter 334B, and IF amplifier 335B, and is output from the output node OUT2 of the GLONASS analog processor 33B to the GLONASS digital convertor 34B.

The GLONASS digital convertor 34B converts the IF signal output from the GLONASS analog processor 33B to a digital signal.

In this embodiment of the invention the GPS processor 31A and GLONASS processor 31B are independent of each other. More specifically, the carrier frequency of GPS satellite signals is 1575.42 MHz, while the frequency of GLONASS signals is centered on 1602.0 MHz. Efficient processing is therefore enabled by using separate analog processors for GPS satellite signals and GLONASS satellite signals.

Baseband Unit Configuration

While not shown in the figures, the hardware configuration of the baseband unit 35 includes a DSP (digital signal processor), CPU (central processing unit), SRAM (static random access memory), RTC (real-time clock). The satellite signal search unit 36, satellite tracker 37, and computing unit 38 described above are embodied by the cooperation of the hardware and software.

Satellite Signal Search Unit

Figure 4:
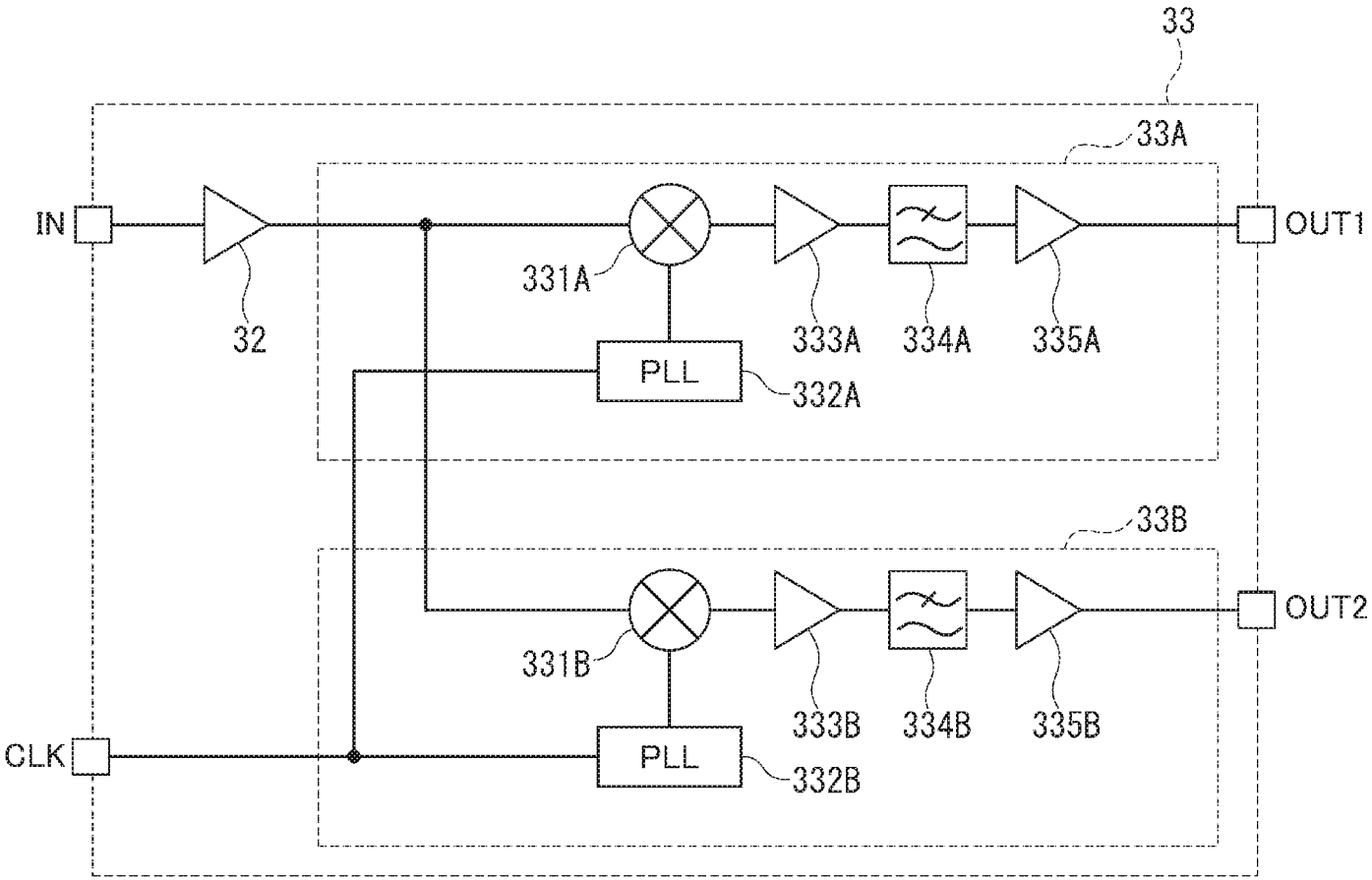
FIG. 4 is a circuit diagram illustrating the analog processor of the receiver according to the invention.

As shown in FIG. 4, the satellite signal search unit 36 includes a GPS satellite signal search unit 36A and GLONASS satellite signal search unit 36B.

In the GPS satellite search process, the GPS satellite signal search unit 36A produces a local code of the same pattern as each C/A code, and runs a process that correlates the local code with the C/A code included in the baseband signal. The GPS satellite signal search unit 36A adjusts the timing for generating the local code to find the peak correlation between the C/A code and local code, and when this correlation exceeds a specific threshold, determines a GPS satellite of the same local code was locked onto.

Note that the GPS system uses a CDMA (Code Division Multiple Access) method whereby all GPS satellites transmit on the same frequency with each satellite using a different C/A code. Therefore, a GPS satellite that can be locked onto can be found by detecting the C/A code contained in the received satellite signal. More specifically, GPS satellites can be found by executing a correlation process using a pseudorandom noise code (PRN) set individually for each GPS satellite.

This embodiment of the invention uses a sliding correlation technique as the correlation method, which is executed primarily by the DSP.

GLONASS satellite signals are transmitted using a FDMA (Frequency Division Multiple Access) method. As a result, the GLONASS satellite signal search unit 36B divides the frequency band at a specific frequency interval to create multiple channels. The GLONASS satellite signal search unit 36B then changes the channel to find a satellite signal.

Satellite Tracker

When the user wearing the electronic timepiece 1 is walking, the electronic timepiece 1 with the receiver 30 is also moving, and because the positioning information satellites 100 are travelling at high speed, the input phase of the satellite signals is constantly changing. To track these changes, the satellite tracker 37 receives satellite signals from the locked positioning information satellite 100 by running the correlation process continuously to find the peak correlation value using the local code.

Because the number of chips in the C/A code is different in GPS signals and GLONASS signals, the tracking processes also differ. As a result, both a GPS satellite tracker 37A and a GLONASS satellite tracker 37B are used to execute separate tracking processes.

Because the modulation method used for GPS satellite signals and the modulation method used for GLONASS signals are different, the satellite signal search unit 36 and satellite tracker 37 operate using a GPS satellite signal search unit 36A and GPS satellite tracker 37A for GPS signals, and a separate GLONASS satellite signal search unit 36B and GLONASS satellite tracker 37B for GLONASS signals.

Computing Unit

To decode signals, the computing unit 38 demodulates the navigation message of the positioning information satellite 100 that is locked and tracked, and acquires time synchronization information, satellite time information, and satellite orbit information. Note that the time synchronization information and satellite time information are described in detail below. The computing unit 38 also generates a synchronization signal (PPS: pulses per second) indicating the seconds update timing based on the time synchronization information, and based on the satellite time information acquires time information including at least the hour, minute, and second. The computing unit 38 then outputs the generated synchronization signal and acquired time information to the controller 40. The computing unit 38 calculates and acquires positioning information for the current location based on the acquired orbit information, and outputs to the controller 40.

The CPU of the baseband unit 35 controls operation of the RF unit 31 and baseband unit 35 appropriately to the reception mode.

More specifically, to find a GPS signal, the baseband unit 35 causes the GPS processor 31A (GPS analog processor 33A and GPS digital convertor 34A) of the RF unit 31, and the GPS satellite signal search unit 36A of the baseband unit 35, to function (operation).

To find a GLONASS signal, the baseband unit 35 causes the GLONASS processor 31B (GLONASS analog processor 33B and GLONASS digital convertor 34B) of the RF unit 31, and the GLONASS satellite signal search unit 36B of the baseband unit 35, to function (operation).

The parts related to GPS satellite signal reception and GLONASS satellite signal reception therefore operate exclusively and do not operate at the same time.

The receiver 30 in this embodiment of the invention therefore has a GPS reception unit 30A that receives satellite signals from GPS satellites using the GPS processor 31A, GPS satellite signal search unit 36A, and GPS satellite tracker 37A.

The receiver 30 also has a GLONASS reception unit 30B as a second reception unit that receives satellite signals from GLONASS satellites using the GLONASS satellite signal search unit 36B and GLONASS satellite tracker 37B.

The GPS reception unit 30A and GLONASS reception unit 30B function exclusively of each other.

Figure 5:
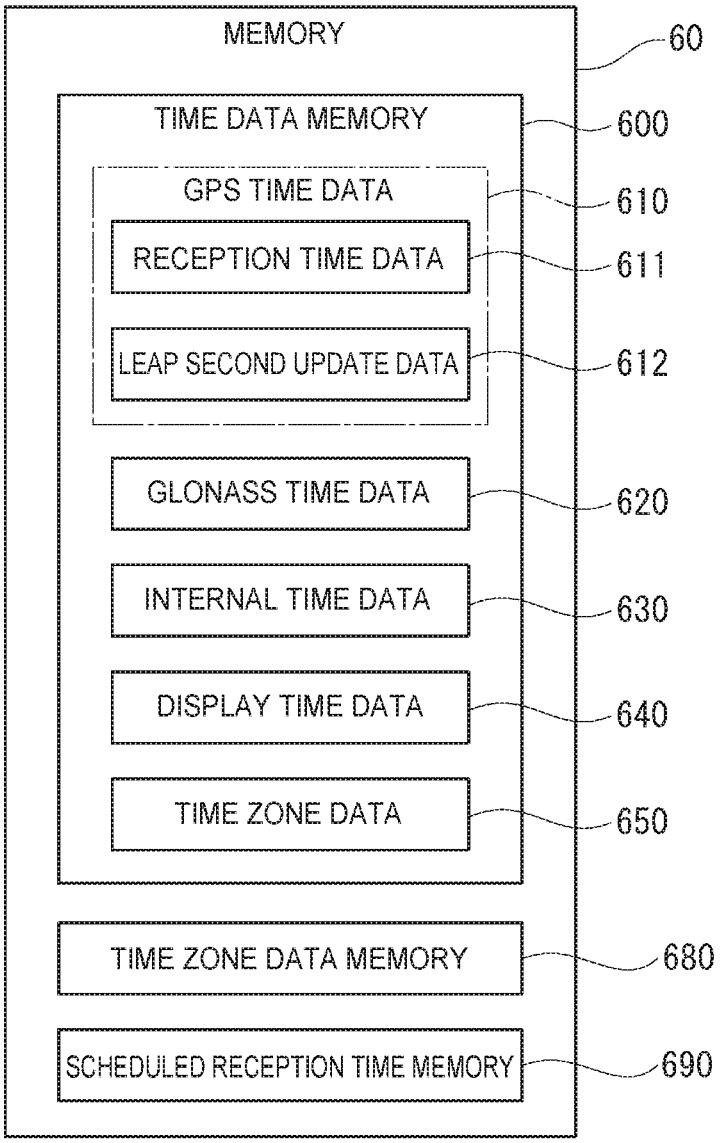
FIG. 5 is a block diagram illustrating the configuration of memory in an embodiment of the invention.

As shown in FIG. 5, the memory 60 includes time data memory 600, time zone data memory 680, and a scheduled reception time memory 690.

The time data memory 600 stores GPS time data 610 acquired from the GPS satellite signal, GLONASS time data 620 acquired from GLONASS satellite signals, internal time data 630, display time data 640, and time zone data 650.

The GPS time data 610 includes reception time data 611, and leap second update data 612.

The reception time data 611 stores the time information (GPS time) acquired from GPS satellite signals. The leap second update data 612 stores at least the current leap second data. More specifically, data related to the leap second, that is, the current leap second value, the week number of the leap second event, the day number of the leap second event, and the future leap second value, is stored on page 18 in subframe 4 of the GPS satellite signal. Of these values, at least the current leap second value is stored in the leap second update data 612.

The GLONASS time data 620 stores the time information (GLONASS time) acquired from the GLONASS satellite signal. Note that the GLONASS time information is UTC, and contains leap second information. As a result, there is no need to separately store leap second data as there is with GPS time.

The internal time data 630 contains internal time information. This internal time information is updated by the time data newly updated by the reception process based on the acquired GPS time data 610 or GLONASS time data 620. More specifically, when the GPS satellite signal is received and the reception time data 611 updated, the internal time data 630 is updated based on the GPS time stored in the reception time data 611 and the current leap second stored in the leap second update data 612. When the GLONASS satellite signal is received and the GLONASS time data 620 updated, the internal time data 630 is updated based on the GLONASS time stored in the GLONASS time data 620. In this event, the internal time data 630 is updated to UTC.

The internal time data 630 is normally updated every second by the timekeeper 47, but when a satellite signal is received and the time information acquired, the internal time data 630 is updated based on the acquired time information. The internal time data 630 therefore stores the current UTC.

The display time data 640 stores the time obtained by adding the time zone data (time difference information) for the time zone data 650 to the internal time information of the internal time data 630. The time zone data 650 is set either by the user manually selecting and setting the time zone, or based on the positioning information acquired in the positioning mode.

The time zone data memory 680 relationally stores the positioning information (latitude and longitude) and time zone (time difference information). As a result, when positioning information is acquired in the positioning mode, the controller 40 can acquire the time zone data based on the positioning information (latitude and longitude).

The time zone data memory 680 relationally stores the name of a city to the time zone data. Therefore, as described above, when the user selects the name of a city for which the current time is desired by manipulating the crown 71 of the input device 70, for example, the controller 40 searches the time zone data memory 680 for the city name selected by the user, gets the time zone data related to that city, and sets the time zone data 650.

The scheduled reception time of the scheduled reception process executed by the receiver 30 is stored in the scheduled reception time memory 690. The time when reception initiated by manually operating the pusher 15 was last successful is stored as the scheduled reception time.

Note that satellite orbit information (almanac, ephemeris) is not stored in memory 60. This is because the electronic timepiece 1 is a wristwatch, memory 60 capacity is limited, the capacity of the storage battery 130 is also limited, and executing the long reception process required to acquire the orbit information is difficult. The reception process of the electronic timepiece 1 is therefore executed in a cold start mode without locally stored orbit information.

Controller

The estimator 43 of the controller 40 estimates the time difference of the internal time to the correct time (the time the positioning information satellite 100 sent).

The mode setter 44 sets a first time correction mode for receiving satellite signals and acquiring time synchronization information; a second time correction mode for acquiring time synchronization information and satellite time information; or a third time correction mode for acquiring time synchronization information, satellite time information, and orbit information. The mode setter 44 sets the first time correction mode or second time correction mode according to the time difference (error) estimated by the estimator 43 when set to the timekeeping mode, and sets the third time correction mode when set to the positioning mode.

The selector 45 selects the type of positioning information satellite 100 from which to receive satellite signals according to the time correction mode that is set.

The reception controller 41 controls the receiver 30 to execute the process corresponding to the time correction mode that is set.

When processing starts in the first time correction mode or second time correction mode, the receiver 30 locks onto at least one positioning information satellite 100, receives the satellite signal transmitted from that positioning information satellite 100, and acquires the time synchronization information and satellite time information. The receiver 30 then outputs a synchronization signal and time information to the controller 40.

When processing starts in the third time correction mode, the receiver 30 locks onto at least three and preferably four positioning information satellites 100, receives the satellite signals transmitted from the positioning information satellites 100, and acquires the time synchronization information, satellite time information, and orbit information. The receiver 30 then outputs a synchronization signal, time information, and positioning information to the controller 40.

The timekeeper 47 has a seconds timer for measuring time less than one second using the clock signal from a crystal oscillator. The seconds timer in this example measures time less than one second in millisecond (ms) units. Every time the seconds timer counts one second, the timekeeper 47 updates the internal time information of the internal time data 630.

More specifically, the year, month, day, hour, minute, and second of the internal time of the electronic timepiece 1 are determined by the internal time information of the internal time data 630, and time shorter than the second value of the internal time is determined by the value counted by the seconds timer.

The time adjustor 42 then resets the seconds timer of the timekeeper 47 to 0 (zero) at the timing the synchronization signal output from the receiver 30 was acquired. As a result, the update (refresh) timing of the seconds value of the internal time is corrected. In other words, the time less than one second of the internal time is corrected.

Based on the time information output from the receiver 30, the time adjustor 42 then updates the internal time information of the internal time data 630.

The time adjustor 42 acquires time zone data (time difference information) from the time zone data memory 680 based on the positioning information (latitude and longitude) output from the receiver 30, and stores the acquired time zone data in the time zone data 650.

For example, because Japan Standard Time (JST) is 9 hours ahead of UTC (UTC+9), if the positioning information acquired in the positioning mode indicates a location in Japan, the controller 40 reads and stores the time difference (+9 hours) from the time zone data memory 680 in the time zone data 650. As a result, the display time data 640 is the time equal to the internal time data 630, which is UTC, plus the time zone data. The time displayed by the hands 21, 22, 23 is thereby corrected.

The difference counter 46 measures the difference between the synchronization signal and the timing for updating the seconds of the internal time, that is, the difference of the time less than one second measured by the seconds timer.

Functions of the controller 40 are described in further detail below.

Navigation Message (GPS Satellite)

The navigation message contained in the satellite signals sent from a GPS positioning information satellite 100 is described next. Note that the navigation message is modulated at 50 bps onto the satellite signal carrier.

Figure 6:
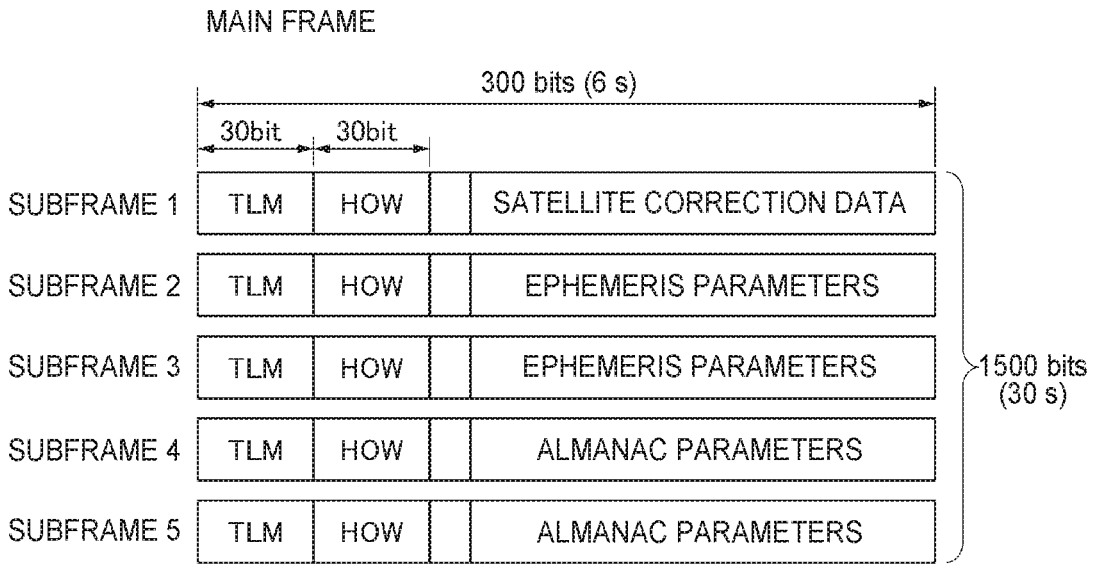
FIG. 6 illustrates the configuration of the main frame of the navigation message of a GPS satellite signal.
Figure 7:
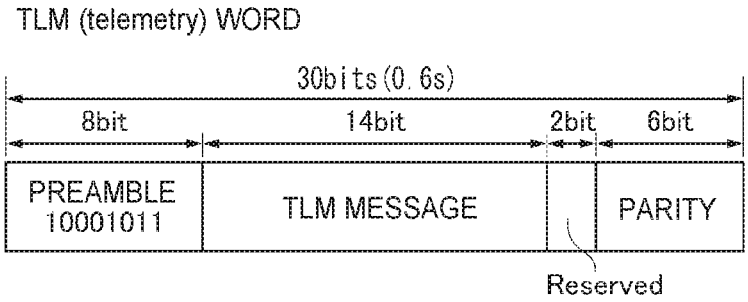
FIG. 7 illustrates the configuration of the TLM (Telemetry) word of the navigation message of a GPS satellite signal.
Figure 8:
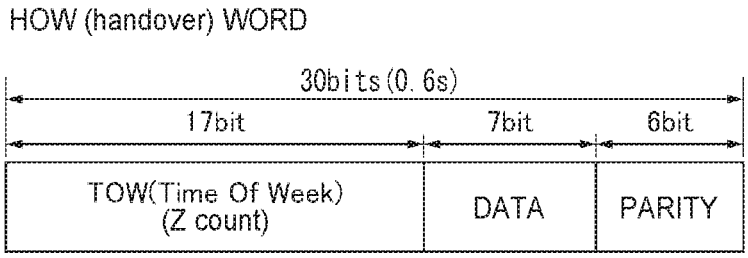
FIG. 8 illustrates the configuration of the HOW (Hand Over) word of the navigation message of a GPS satellite signal.

FIG. 6 to FIG. 8 describe the format of the navigation message.

As shown in FIG. 6, a navigation message is composed of main frames each containing 1500 bits. Each main frame is divided into five subframes 1 to 5 of 300 bits each. The data in one subframe is transmitted in 6 seconds from each GPS satellite. It therefore takes 30 seconds for the data in one main frame to be transmitted from a GPS satellite.

Subframe 1 contains the week number (WN) and satellite correction data.

The week number identifies the week to which the current GPS time information belongs, and is updated every week.

Subframes 2 and 3 contain ephemeris data (detailed orbit information for each GPS satellite). Subframes 4 and 5 contain almanac data (coarse orbit information for all GPS satellites 100).

Each of subframes 1 to 5 starts with a telemetry (TLM) word storing 30 bits of telemetry data followed by a HOW word (handover word) storing 30 bits of handover data.

Therefore, while the TLM and HOW words are transmitted at 6-second intervals from the GPS satellites, the week number data and other satellite correction data, ephemeris parameter, and almanac parameter are transmitted at 30-second intervals.

The TLM word includes time synchronization information indicating the synchronization timing of the time. That is, the time synchronization information is transmitted every 6 seconds. More specifically, as shown in FIG. 7, the TLM word includes preamble data, a TLM word message, reserved bits, and parity data.

As shown in FIG. 8, the HOW word contains GPS time information (standard time information) called the TOW or Time of Week (also called the Z count). The Z count denotes in seconds the time passed since 00:00 of Sunday each week, and is reset to 0 at 00:00 Sunday the next week. More specifically, the Z count denotes the time passed from the beginning of each week in seconds. The Z count denotes the GPS time at which the first bit of the next subframe data is transmitted.

The receiver 30 can therefore acquire date information identifying the current year, month, and day, and time information identifying the hour, minute, and second, by retrieving the week number contained in subframe 1 the HOW word (Z count data) contained in subframes 1 to 5. However, if the week number data was previously received and the time passed from when the week number was acquired is counted internally, the receiver 30 can know the current week number value of the GPS satellite time without acquiring the week number from a satellite signal again.

The receiver 30 therefore only needs to acquire the week number value from subframe 1 when week number data (date information) is not already stored internally, such as after a device reset or when the power is first turned on. If the week number is stored, the receiver 30 can know the current time by simply acquiring the TOW value transmitted every 6 seconds. As a result, the receiver 30 normally acquires only the TOW to acquire the hour, minute, second time information.

Navigation Message (GLONASS Satellite)

GLONASS (a Global Navigation Satellite System) is a satellite system operated by Russia, has 24 satellites in the constellation, uses 21 satellites to transmit satellite signals, and uses the other three satellites as spares. The satellites are on three orbits with eight satellites on each orbit. More specifically, the satellites are on three orbital planes, the longitude of the ascending node differs by 120 degrees from plane to plane, and the eight satellites are located at equal intervals on each plane. As a result, a minimum four satellites can always be seen from Earth.

All GLONASS satellites broadcast the same standard precision (SP) signal, but each satellite transmits on a different frequency. GLONASS uses FDMA (Frequency Division Multiple Access) centered on 1602.0 MHz. Each satellite therefore transmits at a frequency of 1602 MHz+(N×0.5625 MHz), where N is the frequency channel number (N=−7, −6, −5, . . . 5, 6). The maximum 24 satellites are arranged so that signals can always be received on different frequencies from Earth.

One cycle of the GLONASS navigation message is called a "superframe." One superframe is transmitted every 2.5 minutes. Each superframe contains five frames. As shown in FIG. 9, each frame contains 15 strings. The length of each string is 2 seconds, and the length of each frame is 30 seconds.

Each frame contains Immediate data and Non-immediate data. The Immediate data is equivalent to the ephemeris of the GPS satellite signal, and the Non-immediate data is equivalent to the almanac. The current location can be calculated and navigation is possible by receiving the Immediate data.

As shown in FIG. 9, a 0 is transmitted at the beginning of each string. A time mark MB, which is time synchronization information indicating the synchronization timing of the time, is transmitted at the end of each string. More specifically, the time synchronization information is transmitted every 2 seconds. A Hamming code KX for detecting and correcting data errors is transmitted before the time mark MB.

Figure 10:
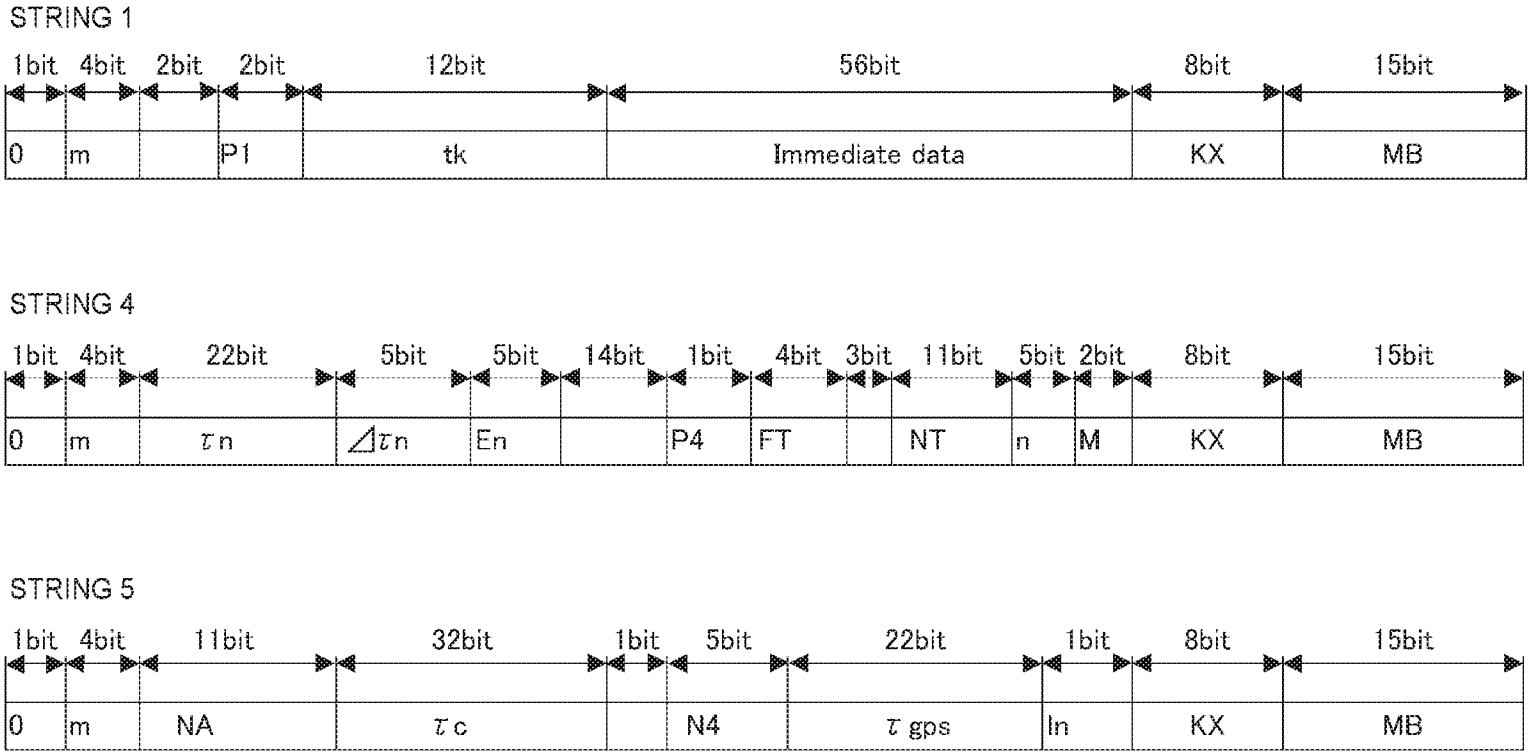
FIG. 10 describes the format of strings 1, 4, and 5 in a GLONASS signal.
Figure 11:
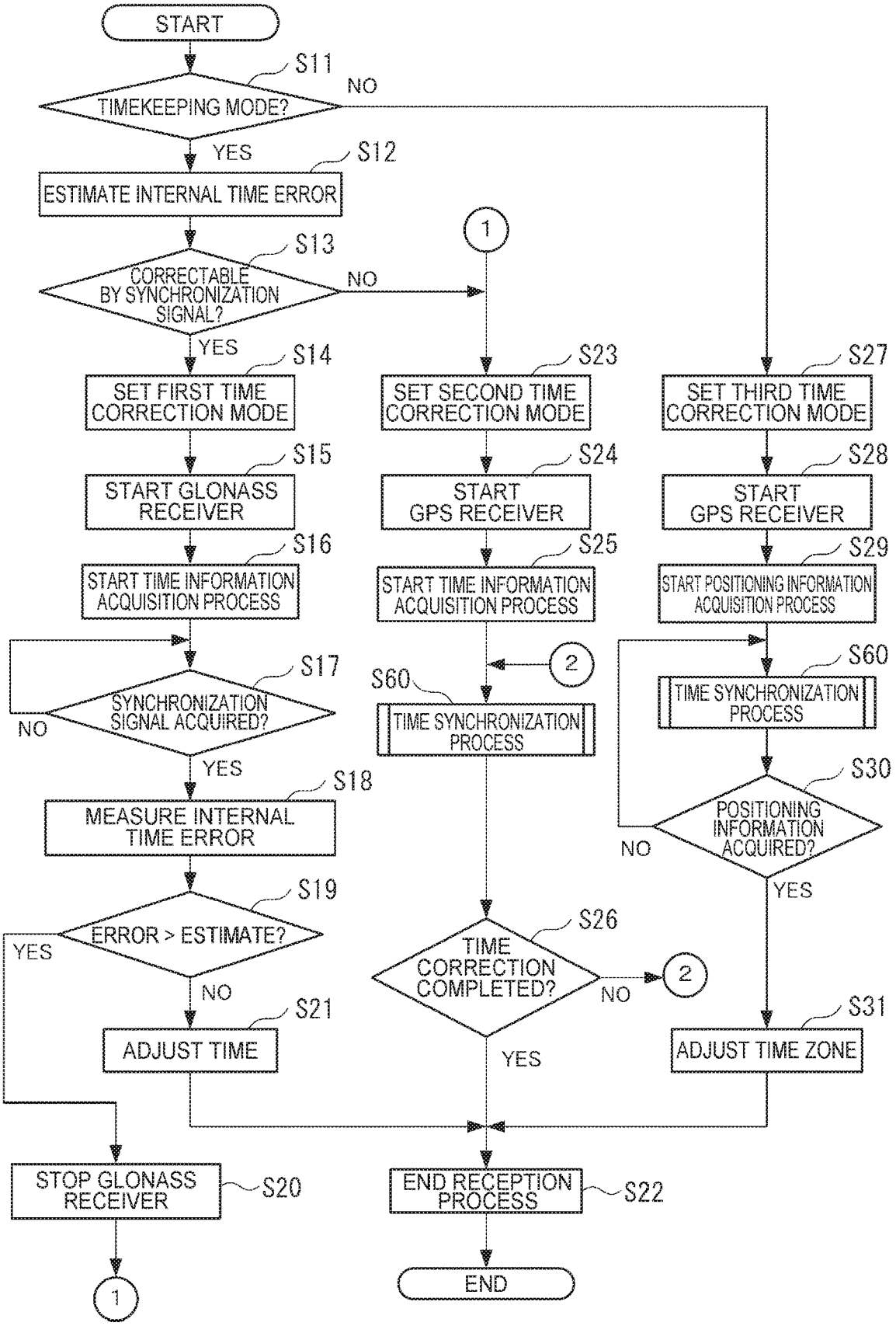
FIG. 11 is a flow chart of the time correction process in an embodiment of the invention.

FIG. 10 shows the format of strings 1, 4, and 5 containing the information required to acquire the time from GLONASS satellite signals.

Word m in each string is 4 bits long and identifies the string number (1 to 15) within the frame.

Word tk (satellite time information) in string 1 is 12 bits long. The first five bits indicate the integer number (0-23) of hours since the beginning of the current day. The next six bits indicate the integer (0-59) number of minutes elapsed since the beginning of the current hour. The last one bit indicates either 0 seconds or 30 seconds. This word tk indicates the UTC at the beginning of the superframe.

Word NT in string 4 is 11 bits long, and indicates the number of days (1-1461) in a four-year period starting from January 1 of a leap year.

Word N4 in string 5 is 5 bits long, and is the four-year interval number (1-31) indicating the number of four-year intervals since 1996.

Word NA is 11 bits long, and indicates the number of days (1-1461) in a four-year period starting from January 1 in a leap year. Word NA thus has the same content as word NT.

The receiver 30 can receive date information for the current year, month, day, and time information for the hour, minute, and second, can be acquired by receiving words N4, NA or NT, timekeeping, and m.

More specifically, the current year, month, day can be acquired by receiving word N4 in string 5 and either word NT in string 4 or word NA in string 5. For example, if N4 is 5 and NA is 10, the date is 2016 Jan. 10. Because the year is 1996+4×N, the year becomes 1996+4×5=2016. Because NA is the number of days since January 1 of a leap year, the date becomes January 10.

To acquire the current hour, minute, and second, word $t_K$ is received and then word m. If word $t_K$ says 10 h 47 m 30 s, the superframe is known to have started at 10:48:30. If the next word m received is 3, that string is known to be string 3. Because one string takes two seconds to send, string 3 is transmitted 6 seconds after the beginning of the superframe. String 3 is therefore known to have been transmitted at 10:48:30 plus 6 seconds, that is, at 10:48:36. The hour, minute, second time information can therefore be acquired by the receiver 30 acquiring word tk transmitted every 30 seconds, and the following word m.

Because GLONASS time is UTC, leap seconds are accounted for in the time. While the leap second information that is transmitted every 12.5 minutes must be received with GPS, GLONASS enables acquiring UTC, which accounts for leap seconds, in a short time.

Time Correction Process

The time correction process executed by the electronic timepiece 1 is described next with reference to the flow charts in FIG. 11 to FIG. 14.

When the conditions for an automatic reception process are met, or the button 73 is operated to manually start reception, the controller 40 starts the time correction process. The controller 40 determines the condition for automatic reception is met when the scheduled reception time set in the scheduled reception time memory 690 arrives; and when the output voltage or output current of the solar panel 135 is greater than or equal to a set threshold, and it can be determined that the solar panel 135 is outdoors and exposed to sunlight.

When the time correction process starts, the mode setter 44 determines whether or not the timekeeping mode was selected (S11). If the automatic reception condition was met, or if the button 73 was pushed for 3 or more and less than 6 seconds to start reception manually, the mode setter 44 determines the timekeeping mode was selected. If the button 73 was pushed for 6 seconds or more, the mode setter 44 determines the positioning mode was selected.

If S11 returns YES, the estimator 43 estimates the error in the internal time (S12). More specifically, the estimator 43 determines the elapsed time since the internal time was last (previously) corrected. The estimator 43 then estimates the error (time difference) in the internal time based on the elapsed time, and the accuracy (monthly deviation) of the electronic timepiece 1, which is determined by the clock precision of the crystal oscillator.

After the internal time is corrected, the error in the internal time increases proportionally to the elapsed time. FIG. 15 is a table showing the relationship between elapsed time and internal time error when the clock precision is 5.8 ppm (parts per million) and the monthly accuracy is ±15 seconds. As shown in FIG. 15, when the monthly accuracy is ±15 seconds, the maximum internal time error increases approximately 20 ms per hour. For example, the maximum error (deviation) for an elapsed time of 12 hours is approximately ±250 ms, and the maximum error (deviation) for an elapsed time of 24 hours is approximately ±500 ms. The internal time error can therefore be estimated based on the elapsed time and the monthly accuracy.

Next, the mode setter 44, based on the (estimated) internal time error calculated by the estimator 43, determines if the internal time can be accurately corrected based on only the synchronization signal output from the receiver 30 (S13).

If the internal time error to the correct time (the time the positioning information satellite 100 transmitted) is less than 1 second, and the internal time is faster than the correct time, the time adjustor 42 can correct adjust the internal time by resetting the seconds timer at the timing when the synchronization signal is acquired. If internal time is slower than the correct time, the time adjustor 42 can correctly adjust the internal time by resetting the seconds timer at the timing when the synchronization signal is acquired, and then advancing the seconds value of the internal time information by 1.

When the internal time error is less than 1 second, the internal time can be correctly adjusted based on the synchronization signal if whether the internal time is faster than the correct time or is slower than the correct time can be determined.

Theoretically, whether the internal time is fast or slow can be determined if the internal time error is less than ±500 ms, which is a half second. More specifically, if the internal time error is less than ±500 ms, and the internal time is fast, the synchronization signal is acquired before 500 ms pass after the second of the internal time is updated. However, if the internal time is slow, the second of the internal time is updated before 500 ms pass after the synchronization signal is acquired. In other words, the synchronization signal is acquired after more than 500 ms pass from when the second of the internal time was updated. As a result, by comparing the timing of synchronization signal acquisition with the timing when the second of the internal time is updated, whether the internal time is faster or slower than the correct time can be determined, and the internal time can be correctly adjusted.

However, if the actual internal time error is nearly ±500 ms due to the clock precision or other factor, correctly determining if the internal time is fast or slow may not be possible. As a result, to provide a certain margin of error, this embodiment determines the internal time can be correctly adjusted based only on the synchronization signal if the internal time error is less than or equal to ±300 ms (S13: YES). However, if the internal time error is greater than ±300 ms, this embodiment determines the internal time cannot be correctly adjusted based only on the synchronization signal (S13: NO).

Note that the internal time error threshold used to determine if the internal time can be accurately corrected based only on the synchronization signal is not limited to ±300 ms, and may be set to a value less than ±500 ms appropriate to the clock precision, for example.

If S13 returns YES, the mode setter 44 sets the first time correction mode to acquire time synchronization information (S14).

The selector 45 then selects GLONASS satellites, which transmit time synchronization information at a shorter interval than GPS satellites, as the positioning information satellite 100 from which to receive satellite signals. The reception controller 41 then instructs the receiver 30 to select GLONASS satellites and execute the reception process in the first time correction mode.

As a result, the receiver 30 activates the GLONASS reception unit 30B (GLONASS processor 31B, GLONASS satellite signal search unit 36B, GLONASS satellite tracker 37B) (S15), and starts the time information acquisition process S40 (S16).

Figure 12:
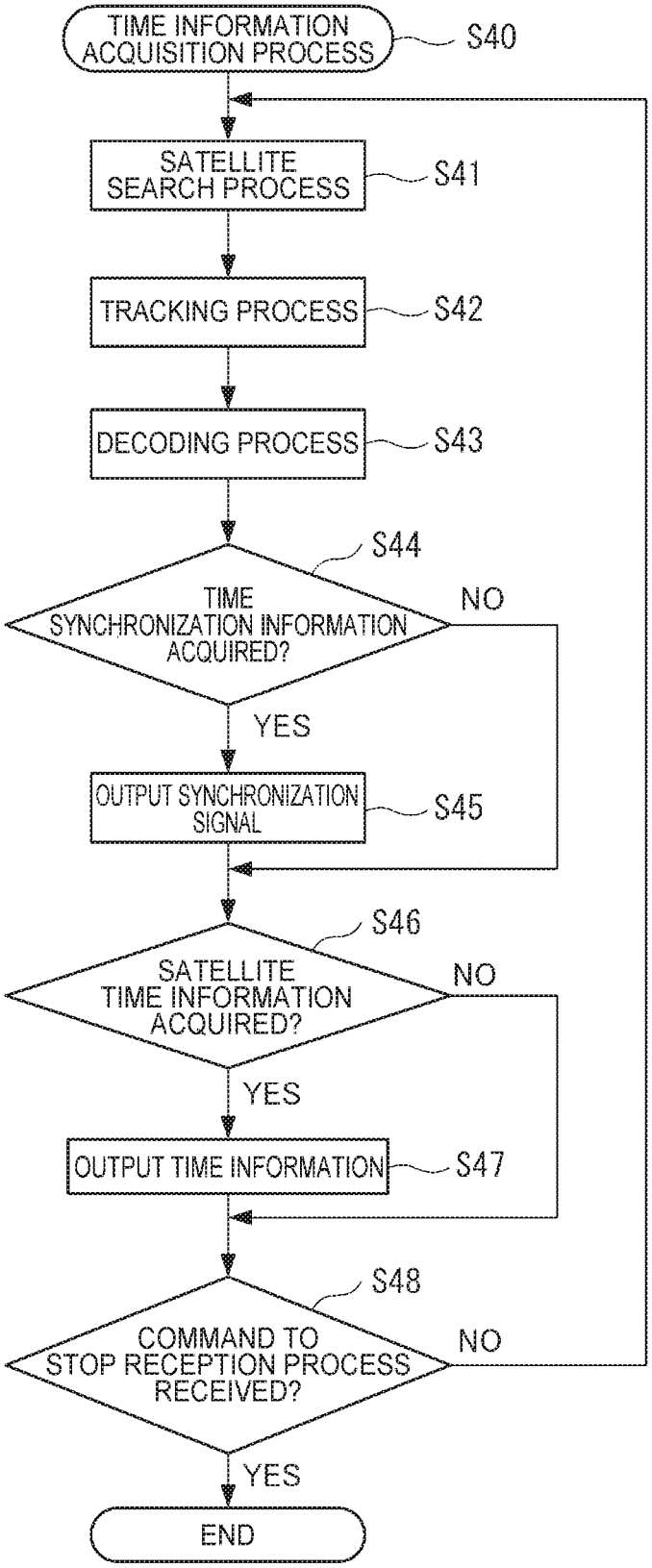
FIG. 12 is a flow chart of the time information acquisition process in an embodiment of the invention.

FIG. 12 is a flowchart of the time information acquisition process S40.

When the time information acquisition process S40 starts, as shown in FIG. 12, the receiver 30 drives the GLONASS processor 31B and GLONASS satellite signal search unit 36B to search for GLONASS satellites (S41). The GLONASS satellite tracker 37B then tracks at least one locked GLONASS satellite and acquires the navigation message (S42). The receiver 30 also executes a decoding process of the computing unit 38 demodulating the navigation message and acquiring the time synchronization information and satellite time information carried in the navigation message (S43).

Next, the computing unit 38 determines if the time synchronization information was successfully acquired through the decoding process (S44). Because GLONASS satellites transmit time synchronization information at a 2-second interval, the computing unit 38 can acquire the time synchronization information within two seconds after the reception process starts if the reception environment is good.

If S44 returns YES, the computing unit 38, based on the time synchronization information, generates and outputs to the controller 40 a synchronization signal (PPS) indicating the timing for updating the seconds value (S45).

After S45, or when S44 returns NO, the computing unit 38 determines if the satellite time information was acquired (S46). Because GLONASS satellites transmit satellite time information at a 30-second interval, if the reception environment is good, the computing unit 38 can acquire the satellite time information within 30 seconds after the reception process starts.

If S46 returns YES, the computing unit 38 acquires the hour, minute, second time information based on the satellite time information, and outputs to the controller 40 (S47).

After S47 or if S46 returns NO, the receiver 30 determines if a command to end the reception process was received from the controller 40 (S48).

If S48 returns NO, the receiver 30 returns to S41. As a result, steps S41 to S48 repeat until a command to end the reception process is received.

If a command to end the reception process is received, S48 returns YES, the receiver 30 stops the GLONASS reception unit 30B, and ends the time information acquisition process S40.

Referring again to FIG. 11, after the time information acquisition process S40 is started in S16, the time adjustor 42 determines whether or not the synchronization signal output from the receiver 30 was acquired (S17). The time adjustor 42 repeats step S17 until the synchronization signal is received or operation times out.

If the synchronization signal is acquired and S17 returns YES, the difference counter 46 calculates the difference between the synchronization signal and the timing for updating the second of the internal time (S18).

Because the estimated internal time error is less than or equal to ±300 ms in this example, if the internal time is fast, the synchronization signal will be acquired in less than 300 ms after the last update timing of the second of the internal time. If the internal time is slow, the second of the internal time will be updated within 300 ms after the synchronization signal is acquired. In other words, the synchronization signal is acquired 700 ms after the second of the internal time is updated.

As a result, the difference counter 46 measures the elapsed time T1 from when the second of the internal time is updated until the synchronization signal is acquired, and determines the internal time is fast if the elapsed time T1 is 300 ms or less. In other words, the difference counter 46 determines the internal time error is +T1 ms.

However, if the elapsed time T1 is 700 ms or more, the difference counter 46 determines the internal time is slow. In this event, the difference counter 46 determines the internal time error is −(1000 ms−T1 ms). For example, if T1 is 800 ms, the difference counter 46 determines the internal time error is −200 ms.

Next, the mode setter 44 determines if the difference calculated by the difference counter 46 is greater than or equal to the estimate from the estimator 43 (S19).

If S19 returns YES, the actual difference is greater than the estimate, and whether or not the internal time can be corrected based only on the synchronization signal is unknown. As a result, the reception controller 41 instructs the receiver 30 to stop the reception process in the first time correction mode. As a result, the receiver 30 stops the GLONASS reception unit 30B (S20). In step S23 described below, the mode setter 44 then sets the second time correction mode to acquire time synchronization information and satellite time information.

If S19 returns NO, the time adjustor 42 corrects the internal time (S21). More specifically, if the internal time is ahead of the correct time, the time adjustor 42 can correct adjust the internal time by resetting the seconds timer timed to synchronization signal reception, and correcting the timing for updating the second of the internal time. However, if the internal time is behind the correct time, the time adjustor 42 can correctly adjust the internal time by resetting the seconds timer timed to synchronization signal reception, and advancing the value of the second of the internal time information 1.

The process of steps S18 to S21 are described next with reference to FIG. 16 to FIG. 18.

Figure 16:
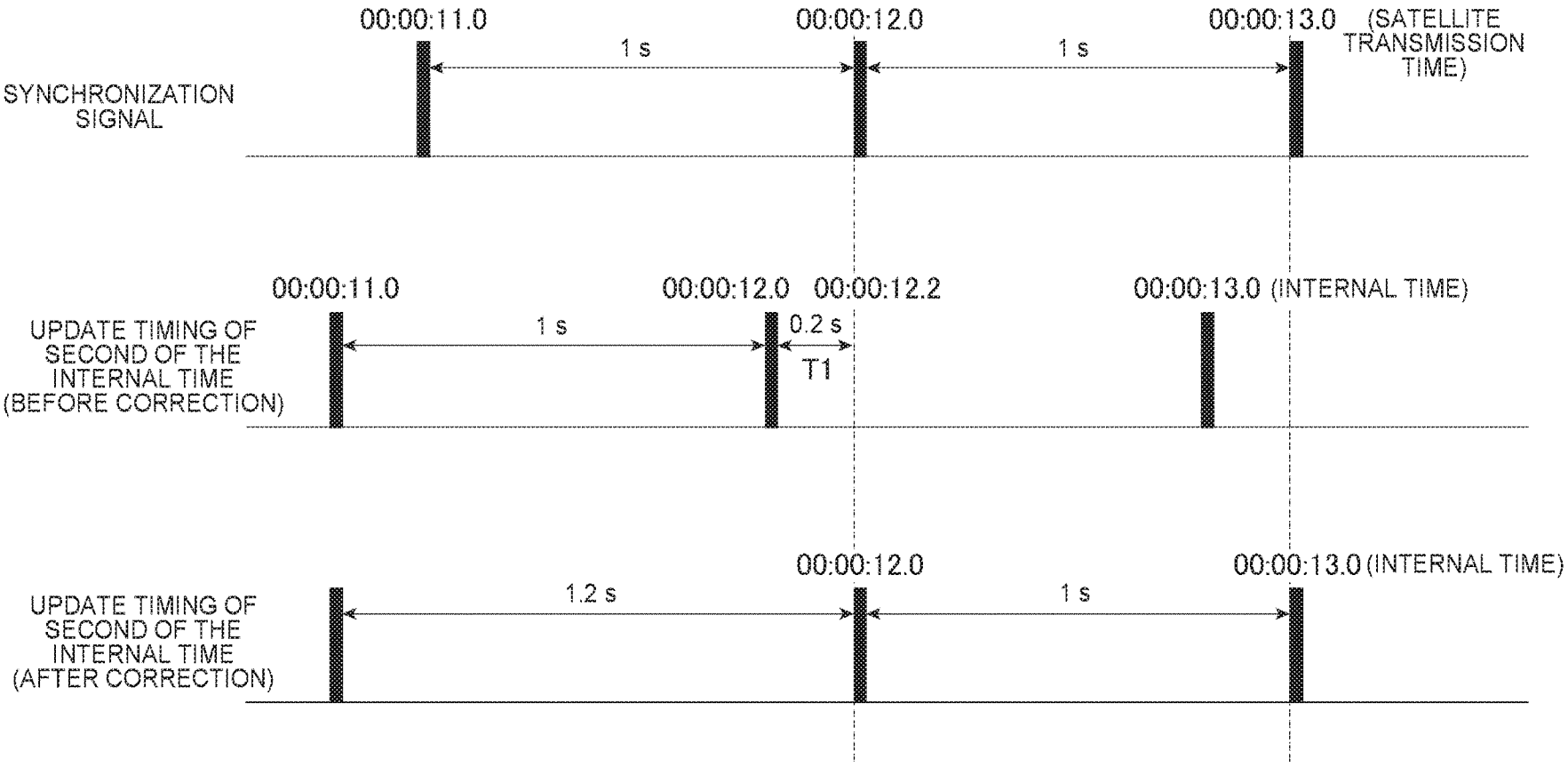
FIG. 16 shows an example of correcting the internal time in an embodiment of the invention.

FIG. 16 shows an example of correcting the internal time when the estimated difference is ±250 ms, and the internal time is 200 ms ahead of the correct time.

In this example, before correcting the time, the elapsed time T1 from when the second of the internal time was updated to when the synchronization signal is acquired is 200 ms (0.2 s), is therefore less than 300 ms, and the internal time can be determined to be fast. Furthermore, because the difference is +200 ms and thus less than the estimate, the internal time is corrected based on the synchronization signal.

More specifically, if before the time is adjusted the time transmitted by the positioning information satellite 100 is 00h 00m 12.0 s, the internal time is 00h 00m 12.2 s, but the seconds timer is reset by acquiring the synchronization signal, and the internal time is correctly adjusted to 00h 00m 12.0 s.

Figure 17:
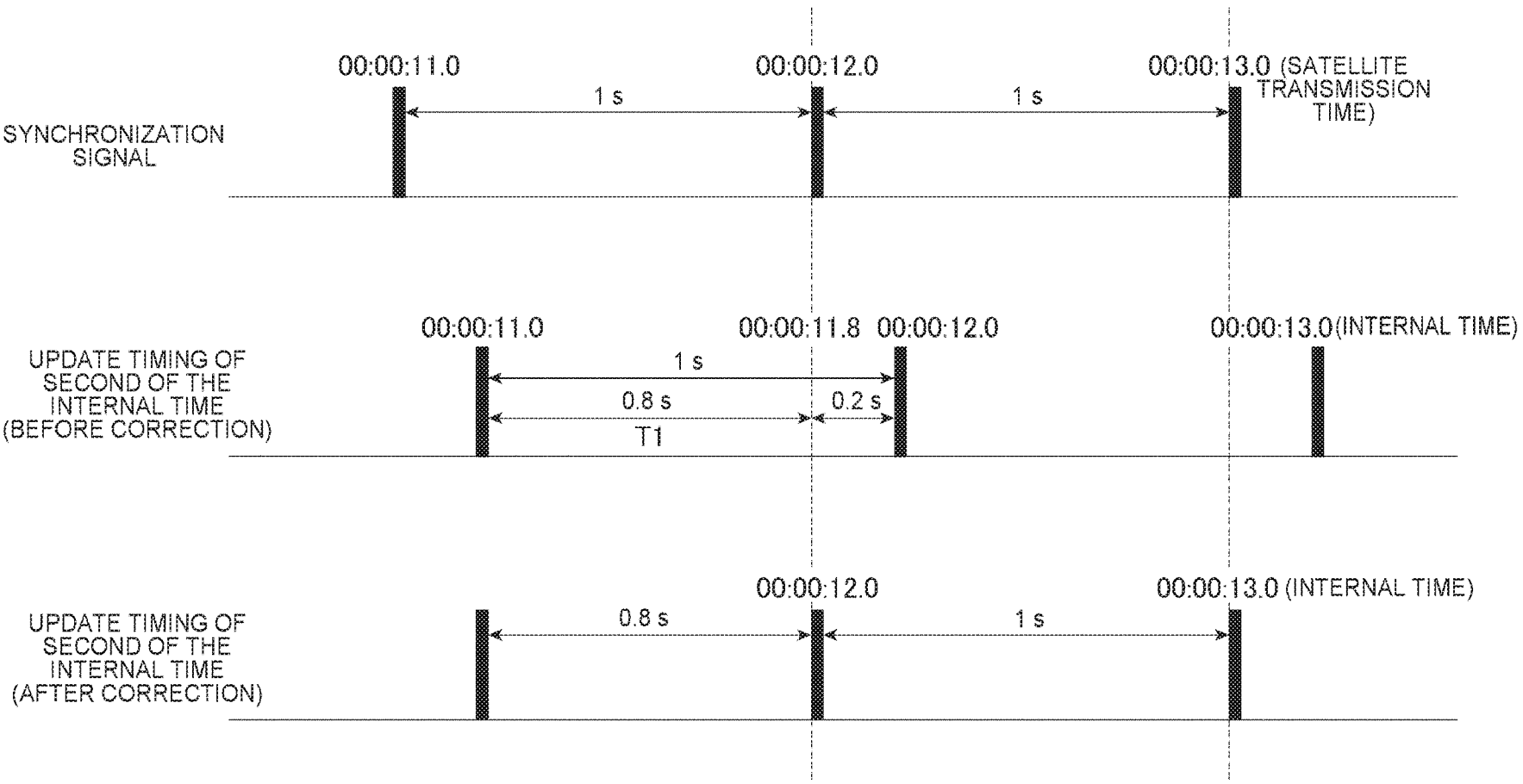
FIG. 17 shows an example of correcting the internal time in an embodiment of the invention.

FIG. 17 shows an example of correcting the internal time when the estimated difference is ±250 ms, and the internal time is 200 ms slower than the correct time.

In this example, before correcting the time, the elapsed time T1 from when the second of the internal time was updated to when the synchronization signal is acquired is 800 ms (0.8 s), is therefore greater than 700 ms, and the internal time can be determined to be slow. Furthermore, because the difference is −200 ms and thus less than the estimate, the internal time is corrected based on the synchronization signal.

More specifically, if before the time is adjusted the time transmitted by the positioning information satellite 100 is 00h 00m 12.0 s, the internal time is 00h 00m 11.8 s, but the seconds timer is reset by acquiring the synchronization signal, and second of the internal time is advanced 1. As a result, the internal time is correctly adjusted to 00h 00m 12.0 s.

Figure 18:
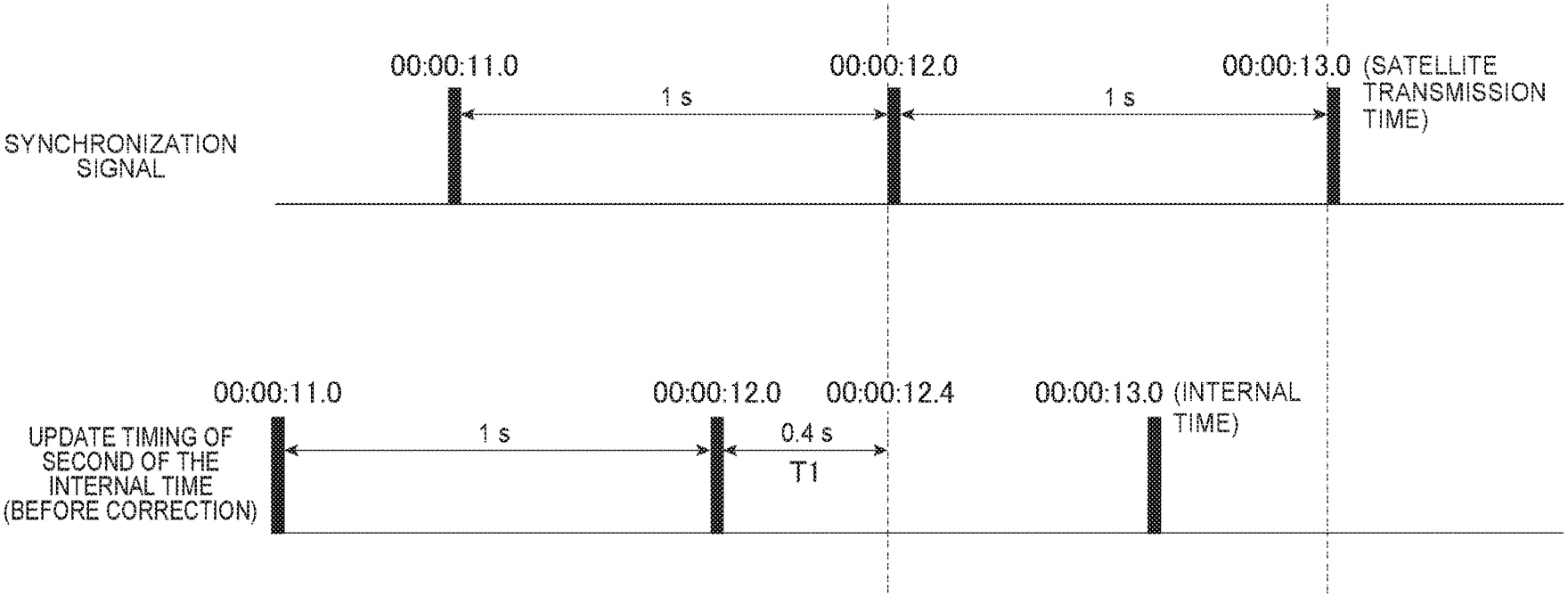
FIG. 18 shows an example of correcting the internal time in an embodiment of the invention.

FIG. 18 shows an example of correcting the internal time when the estimated difference is ±250 ms, and the internal time is 400 ms faster than the correct time.

In this example, the difference is +400 ms and greater than the estimate. The internal time is therefore not corrected by the synchronization signal, and the second time correction mode is set to acquire satellite time information in addition to the time synchronization information.

Returning to FIG. 11, after the internal time is corrected in S21, or if operation times out, the reception controller 41 commands the receiver 30 to end the reception process (S22). As a result, the receiver 30 stops the GLONASS reception unit 30B, and ends the time information acquisition process S40. The controller 40 then ends the time correction process.

If the internal time error is greater than 300 ms, and S13 returns NO, the mode setter 44 sets the second time correction mode to acquire time synchronization information and satellite time information (S23). The process of S23 is executed when the internal time error determined by the difference counter 46 is greater than the estimate, and the reception process of the first time correction mode is stopped in S20.

When the second time correction mode is set, the selector then selects GPS satellites, which transmit satellite time information at a shorter interval than GLONASS satellites, as the positioning information satellites 100 from which to receive satellite signals. The reception controller 41 then instructs the receiver 30 to select GPS satellites and execute the reception process in the second time correction mode.

As a result, the receiver 30 activates the GPS reception unit 30A (GPS processor 31A, GPS satellite signal search unit 36A, GPS satellite tracker 37A) (S24), and starts the time information acquisition process by the GPS reception unit 30A (S25).

The time information acquisition process in this event is the same as the process executed in the time information acquisition process S40 described above, and further description thereof is omitted. Because GPS satellites transmit time synchronization information and satellite time information at a 6-second interval, if the reception environment is good, the computing unit 38 can acquire the time synchronization information and satellite time information within six seconds.

Next, the time adjustor 42 executes the time synchronization process S60.

Figure 13:
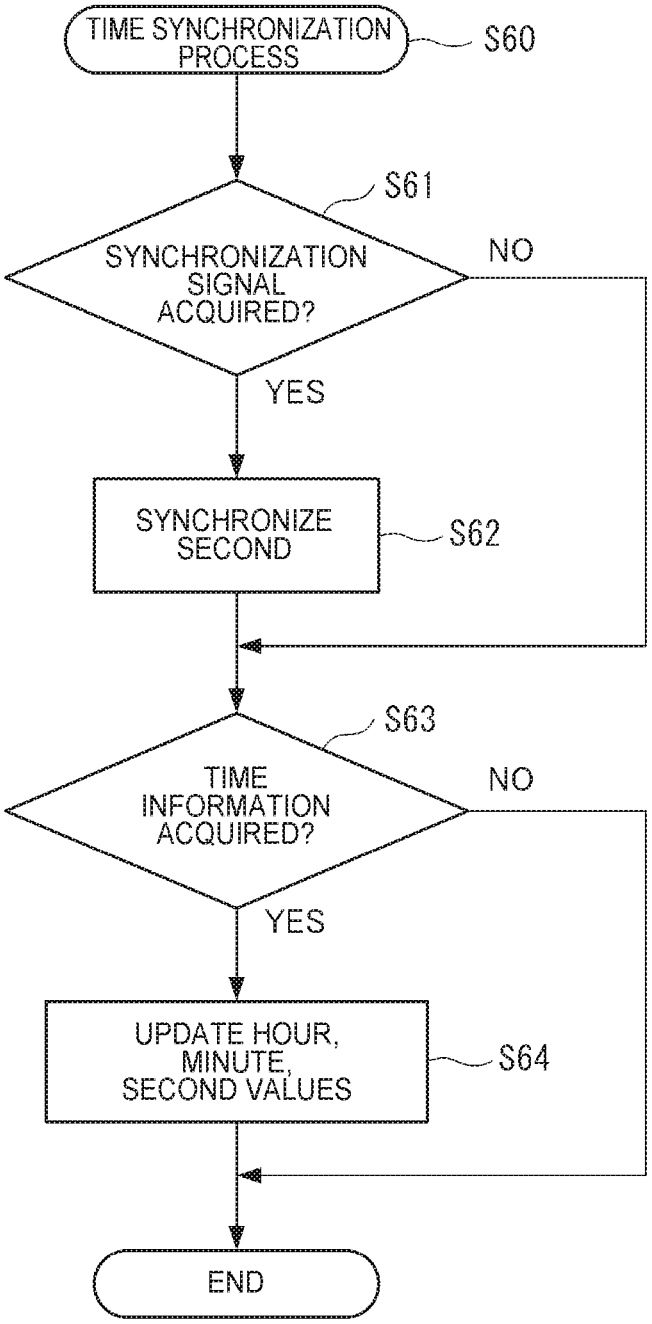
FIG. 13 is a flow chart of the time synchronization process in an embodiment of the invention.

FIG. 13 is a flowchart of the time synchronization process S60.

As shown in FIG. 13, when the time synchronization process S60 executes, the time adjustor 42 determines whether or not the synchronization signal output from the receiver 30 was acquired (S61).

If S61 returns YES, the time adjustor 42 resets the seconds timer timed to acquisition of the synchronization signal (seconds synchronization). As a result, the update timing of the second of the internal time is corrected (S62).

After S62, or if S61 returns NO, the time adjustor 42 determines if the time information output from the receiver 30 was acquired (S63).

If S63 returns YES, the time adjustor 42 updates the internal time data 630 based on the acquired time information. As a result, the values of the hour, minute, second of the internal time are updated (S64). Note that if date information is acquired with the time information, the internal time data 630 is updated by the date information. As a result, the year, month, day of the internal time are also updated.

After S64, or if S63 returns NO, the time adjustor 42 ends the time synchronization process S60.

Referring again to FIG. 11, after time synchronization process S60, the time adjustor 42 determines if the hour, minute, second values of the internal time, and the update timing of the seconds value, were corrected, and if adjusting the time was completed (S26).

If S26 returns NO, the time adjustor 42 returns operation to the time synchronization process S60. As a result, the time synchronization process S60 and step S26 repeat until S26 returns YES, or operation times out.

If S26 returns YES, it can be determined that the internal time was correctly adjusted, and in S22 the reception controller 41 instructs the receiver 30 to end the reception process. As a result, the receiver 30 stops operation of the GPS reception unit 30A and ends the time information acquisition process. The controller 40 then ends the time correction process.

When S11 returns NO, that is, when the in the positioning mode, the mode setter 44 sets the third time correction mode to acquire time synchronization information, satellite time information, and orbit information (S27).

Because the reception process of the positioning mode locks onto more positioning information satellites 100 than the reception process in the timekeeping mode, power consumption in the reception process is high. As a result, the selector 45 selects GPS satellites, which consume less power in the reception process than GLONASS satellites, as the positioning information satellites 100 from which to receive satellite signals. The reception controller 41 then instructs the receiver 30 to select GPS satellites and execute the reception process in the third time correction mode.

As a result, the receiver 30 activates the GPS reception unit 30A (S28), and starts the positioning information acquisition process S40B by the GPS reception unit 30A (S29).

Figure 14:
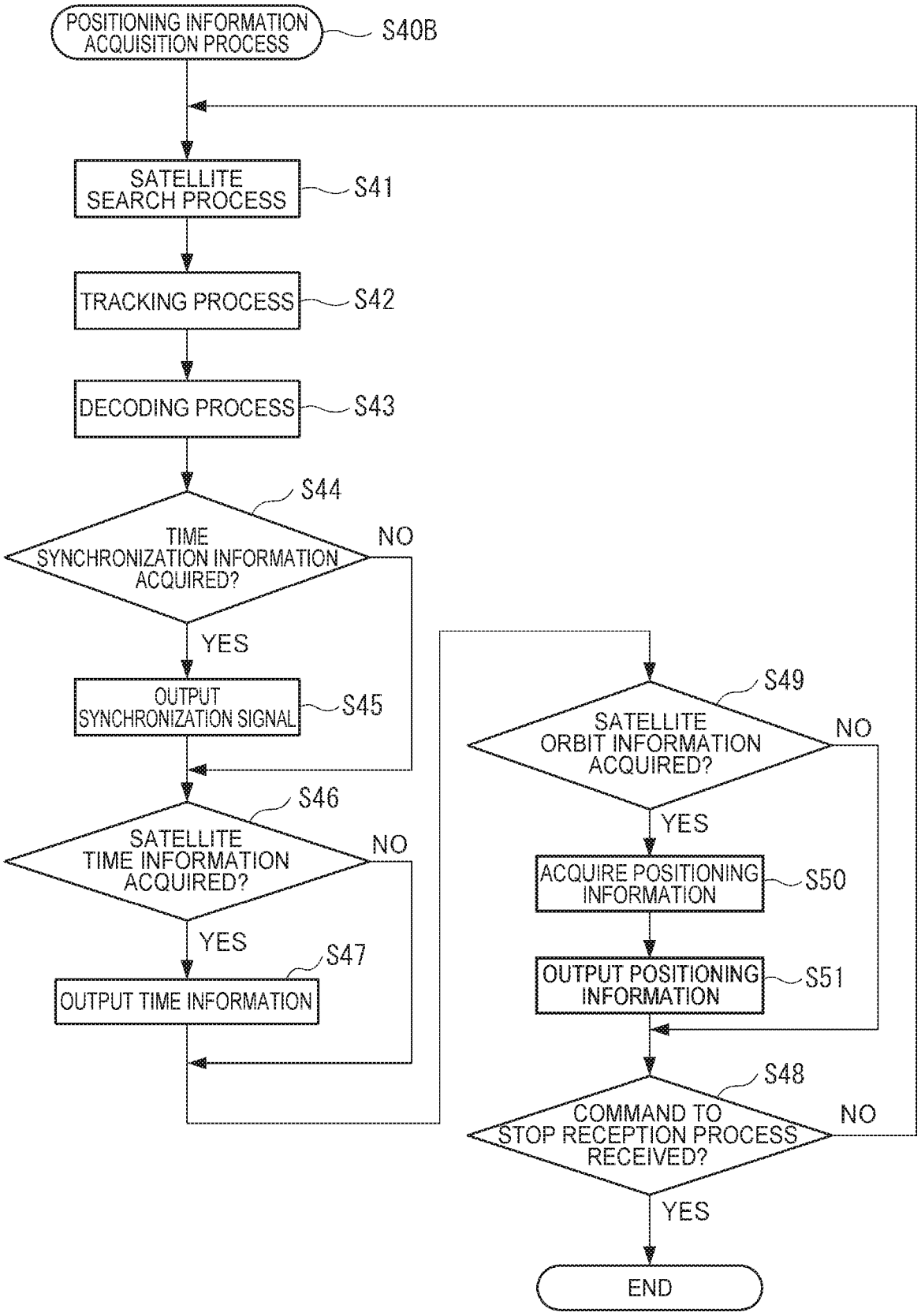
FIG. 14 is a flow chart of the positioning information acquisition process in an embodiment of the invention.

FIG. 14 is a flow chart of the positioning information acquisition process S40B.

In the positioning information acquisition process S408, the process of S41-S51 is executed. The process of S41-S48 is the same as the process of S41 to S48 in the time information acquisition process S40, and further description thereof is omitted.

Note that in the positioning information acquisition process S40B, the receiver 30 tracks at least three and preferably four positioning GPS satellites in S42 to acquire the navigation message. Then in S43, the computing unit 38 executes a decoding process of demodulating the navigation message and acquiring the time synchronization information, satellite time information, and orbit information carried in the navigation message.

In the positioning information acquisition process S40B, after the time information is output in S47, the computing unit 38 determines if the satellite orbit information was acquired (S49).

If S49 returns YES, the computing unit 38 calculates and acquires positioning information for the current location based on the orbit information (S50), and outputs to the controller 40 (S51).

After S51, or if S49 returns NO, the receiver 30 determines in S48 if a command to end the reception process was received from the controller 40.

Returning to FIG. 11, after the positioning information acquisition process S408 was started in S29, the time adjustor 42 executes the time synchronization process S60 described above.

After the time synchronization process S60, the time adjustor 42 determines whether or not positioning information output from the receiver 30 was acquired (S30).

If S30 returns NO, the time adjustor 42 returns processing to the time synchronization process S60. As a result, the time synchronization process S60 and step S30 repeat until S30 returns YES or operation times out.

If S30 returns YES, the time adjustor 42 acquires time zone data from the time zone data memory 680 based on the acquired positioning information, and updates (corrects) the time zone data 650 based on the acquired time zone data (S31). As a result, the display time data 640 is updated and the displayed time is adjusted.

In S22, the reception controller 41 then instructs the receiver 30 to end the reception process. As a result, the receiver stops the GPS reception unit 30A and ends the positioning information acquisition process S40B. The controller 40 then ends the time correction process.

Operating Effect

The electronic timepiece 1 thus comprised can shorten the time required to correct the internal time after the reception process starts both when the internal time is corrected by acquiring only time synchronization information, and when the internal time is corrected by acquiring time synchronization information and satellite time information.

More specifically, when correcting the internal time by acquiring time synchronization information, the electronic timepiece 1 acquires the time synchronization information by receiving satellite signals from GLONASS satellites, which transmit time synchronization information every two seconds. As a result, the time required to correct the internal time can be shortened compared with acquiring the time synchronization information from GPS satellites, which transmit time synchronization information every six seconds.

Furthermore, when correcting the internal time by acquiring time synchronization information and satellite time information, the electronic timepiece 1 acquires the time synchronization information and satellite time information by receiving satellite signals from GPS satellites, which transmit time synchronization information and satellite time information every six seconds. As a result, the time required to correct the internal time can be shortened compared with acquiring the time synchronization information and satellite time information from GLONASS satellites, which transmit time synchronization information every two seconds and satellite time information every 30 seconds.

Furthermore, because the time required to correct the internal time can be shortened, the time required for the reception process can be shortened, and power consumption can be reduced.

The GPS reception unit 30A and GLONASS reception unit 30B function exclusively of each other, and do not function simultaneously. As a result, power consumption can be reduced compared with a configuration in which the GPS reception unit 30A and GLONASS reception unit 30B function simultaneously.

The estimator 43 estimates the error in the currently set internal time based on the time past since the time was last adjusted, and the accuracy (monthly deviation) of the timepiece, and can therefore accurately estimate the error. As a result, the internal time can be accurately corrected.

Furthermore, if the first time correction mode is set but the actual error in the internal time is greater than the estimated difference due to the reception environment or other factor, and whether or not the internal time can be adjusted correctly based only on the synchronization signal is not known, a second time correction mode is set. In this event, the internal time is corrected based on the synchronization signal and satellite time information, and the internal time can therefore be adjusted correctly.

When the third time correction mode is set and the positioning information reception process executes, satellite signals can be received from GPS satellites, which require less power for the reception process than GLONASS satellites, and power consumption can therefore be reduced.

Other Embodiments

The invention is not limited to the embodiments described above, and can be modified and improved in many ways without departing from the scope of the accompanying claims.

The foregoing embodiments describe the receiver 30 as receiving satellite signals from GPS satellites and GLONASS satellites as examples of positioning information satellites 100, but the invention is not so limited. For example, satellite signals may be received from positioning information satellites 100 used in Global Navigation Satellite Systems (GNSS) such as Galileo (EU) and BeiDou (China). Geostationary satellites such as used in satellite-based augmentation systems (SBAS), and quasi-zenith satellites (such as Michibiki) used in radio navigation satellite systems (RNSS) that can only be used in specific regions, can also be used.

In such cases, when the first time correction mode is set, the selector 45 selects the type of satellite for which the average time required to acquire the time synchronization information (that is, the time synchronization information transmission interval) is shortest as the positioning information satellites 100 from which to receive satellite signals.

When the second time correction mode is set, the selector 45 selects the type of satellite for which the average time required to acquire the time synchronization information and satellite time information (that is, for which the time synchronization information transmission interval or satellite time information transmission interval is greater) is shortest.

When the third time correction mode is set, the selector 45 selects the type of satellite requiring the least power consumption in the reception process.

In the foregoing embodiments, the internal time may be faster or slower than the correct time, but the controller 40 may be designed so that the internal time is only adjusted forward. In this event, there is no need to determine if the internal time is faster or slower than the correct time, and the internal time can be set correctly by resetting the seconds timer timed to acquisition of the synchronization signal when the estimated internal time error is less than one second, for example.

In the embodiment described above, when the first time correction mode is set, the internal time error is greater than the estimated value, and the second time correction mode is then set, the receiver 30 does not need to acquire satellite time information from GPS satellites if satellite time information is already acquired from GLONASS satellites.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

The entire disclosure of Japanese Patent Application No. 2017-006218, filed Jan. 17, 2017 is expressly incorporated by reference herein.

What is claimed is:

1. An electronic timepiece comprising:

a receiver configured to receive a first satellite signal transmitted from a first positioning information satellite and a second satellite signal transmitted from a second positioning information satellite;

an estimator configured to estimate internal time error;

a mode setter configured to set a first time correction mode or second time correction mode according to the estimated internal time error;

a selector configured to select one of the first positioning information satellite and the second positioning information satellite according to the set one of the first time correction mode and the second time correction mode as a set time correction mode;

a reception controller configured to control the receiver to execute a process appropriate to the set time correction mode; and a time adjustor configured to correct an internal time, wherein the first satellite signal and the second satellite signal each contain respective time synchronization information, a transmission interval of the time synchronization information of the second satellite signal is longer than a transmission interval of the time synchronization information of the first satellite signal, the second satellite signal contains satellite time information, when the first time correction mode is set, the receiver receives the first satellite signal, acquires at least the time synchronization information of the first satellite signal, and outputs a synchronization signal indicating a seconds update timing based on the time synchronization information, the time adjustor corrects the internal time based on the synchronization signal, when the second time correction mode is set, the receiver receives the second satellite signal, acquires the time synchronization information and the satellite time information of the second satellite signal, and outputs the synchronization signal and time information, and the time adjustor corrects the internal time based on the synchronization signal and the satellite time information.

2. The electronic timepiece described in claim 1, wherein:

the estimator counts an elapsed time from when the internal time was corrected, and estimates the internal time error based on the elapsed time and an accuracy of the timepiece.

3. The electronic timepiece described in claim 1, wherein:

the selector, when the first time correction mode is set, selects the one of the first positioning information satellite and the second positioning information satellite that transmits the time synchronization information at a shortest interval, and when the second time correction mode is set, selects the one of the first positioning information satellite and the second positioning information satellite for which the longer of the transmission interval and a satellite time information transmission interval is shortest.

4. The electronic timepiece described in claim 1, wherein:

the receiver can receive satellite signals transmitted from GLONASS satellites; and the selector selects GLONASS satellites when the first time correction mode is set.

5. The electronic timepiece described in claim 1, wherein:

the receiver can receive satellite signals transmitted from GPS satellites; and the selector selects GPS satellites when the second time correction mode is set.

6. The electronic timepiece described in claim 1, further comprising:

a difference counter configured to measure the difference between the update timing of the second of the internal time, and the synchronization signal when the first time correction mode is set; and the mode setter sets the second time correction mode when the first time correction mode is set and the difference measured by the difference counter is greater than the error estimated by the estimator.

7. The electronic timepiece described in claim 1, wherein:

the receiver is configured to execute a timekeeping reception process and a positioning reception process;

the mode setter sets the first time correction mode or second time correction mode according to the estimated internal time error when the receiver executes the timekeeping reception process, and sets a third time correction mode when the receiver executes the positioning reception process; and when the third time correction mode is set, the receiver calculates and acquires positioning information based on the satellite signals transmitted from the one of the first positioning information satellite and the second positioning information satellite selected by the selector, and the time adjustor adjusts a displayed time based on the acquired positioning information.

8. An electronic timepiece comprising:

a GLONASS receiver configured to receive a first satellite signal transmitted from a GLONASS satellite and acquire a time synchronization signal of the first satellite signal;

a GPS receiver configured to receive a second satellite signal transmitted from a GPS satellite and acquire a time synchronization signal of the second satellite signal and satellite time information;

a timekeeping unit configured to keep an internal time; and an estimator configured to estimate internal time error, wherein a transmission interval of the time synchronization signal of the second satellite signal is longer than a transmission interval of the time synchronization signal of the first satellite signal;

the electronic timepiece drives a selected one of the GLONASS receiver and the GPS receiver based on the estimated internal time error when correcting the internal time, the internal time is adjusted based on the time synchronization information of the first satellite signal when the GLONASS receiver is driven, and the internal time is adjusted based on the time synchronization signal of the second satellite signal and the satellite time information when the GPS receiver is driven.

9. The electronic timepiece described in claim 8, wherein:

the estimator counts an elapsed time from when the internal time was corrected, and estimates the internal time error based on the elapsed time and an accuracy of the timepiece.

10. The electronic timepiece described in claim 8, wherein:

the electronic timepiece measures the internal time error based on the time synchronization signal of the first satellite when the GLONASS receiver is driven, and when the measured internal time error is greater than the error estimated by the estimator, drives the GPS receiver without correcting the internal time based on the time synchronization information of the second satellite.

* * * * *